US007661569B2

(12) United States Patent
Matsukawa

(10) Patent No.: US 7,661,569 B2
(45) Date of Patent: Feb. 16, 2010

(54) STAPLER

(75) Inventor: Takeshi Matsukawa, Tokyo (JP)

(73) Assignee: Plus Stationery Corporation, Tokyo (JP)

( * ) Notice: Subject to any disclaimer, the term of this patent is extended or adjusted under 35 U.S.C. 154(b) by 109 days.

(21) Appl. No.: 12/107,093

(22) Filed: Apr. 22, 2008

(65) Prior Publication Data

US 2009/0152318 A1 Jun. 18, 2009

(30) Foreign Application Priority Data

Dec. 13, 2007 (JP) ..... 2007-322550

(51) Int. Cl.
*B25C 5/00* (2006.01)

(52) U.S. Cl. ..... 227/129; 227/119; 227/134

(58) Field of Classification Search ..... 227/129, 227/119, 134
See application file for complete search history.

(56) References Cited

U.S. PATENT DOCUMENTS 3,758,016 A * 9/1973 Olney et al. ..... 227/132
4,025,031 A * 5/1977 Chi ..... 227/132
2003/0115738 A1* 6/2003 Barlow et al. ..... 29/592
2004/0245310 A1* 12/2004 Masuda et al. ..... 227/134
2005/0139631 A1* 6/2005 Marks ..... 227/134
2006/0102688 A1* 5/2006 Marks ..... 227/134
2006/0106404 A1* 5/2006 Cheng et al. ..... 606/142
2006/0118593 A1* 6/2006 Tsai ..... 227/76
2006/0124686 A1* 6/2006 Barlow et al. ..... 227/134
2006/0124687 A1* 6/2006 Elonsson et al. ..... 227/134
2007/0227286 A1* 10/2007 Kandasamy ..... 74/469
2009/0050669 A1* 2/2009 Zolentroff ..... 227/129
2009/0072003 A1* 3/2009 Matsukawa ..... 227/120
2009/0184150 A1* 7/2009 Tsai ..... 227/134

FOREIGN PATENT DOCUMENTS

JP S63-43027 Y2 11/1988
JP H2-48229 Y2 12/1990

* cited by examiner

*Primary Examiner*—Brian D Nash
(74) *Attorney, Agent, or Firm*—The Marbury Law Group PLLC

(57) ABSTRACT

A flat-type stapler is provided which can fasten a large number of sheets of paper with a small force and in a smooth fashion. The stapler includes a base portion, a magazine portion, a push-down member, handle supporting members, and a handle portion. The handle portion causes the push-down portion to descend by virtue of the principle of the lever with the handle shaft made to act as a movable fulcrum. A portion of the handle may be used to apply force, and the connecting shaft may be used as a point of action.

3 Claims, 17 Drawing Sheets

STAPLER

CROSS-REFERENCE TO RELATED APPLICATIONS

This application is based upon and claims the benefit of priority from the prior Japanese Patent Application No. 2007-322550, field on Dec. 13, 2007; the entire contents of which are incorporated herein by reference.

BACKGROUND OF THE INVENTION

1. Technical Field

The present invention relates to a stapler of a flat type in which ends of a wire staple are driven flat after they have penetrated and fastened together sheets of paper.

2. Background Art

A stapler, which is stationery for fastening sheets of paper, is an inevitable item as one of office materials, and there have been made many proposals on staplers. In the staplers, there are two types: one is a type in which distal end portions of a staple are bent curvedly after they have penetrated and fastened sheets of paper and the other is a type in which end portions of a staple are bent flat after they have penetrated and fastened sheets of paper.

A general flat type stapler includes a base portion having a clincher, a magazine which houses staples, a handle which is rotatably attached to a portion of the base portion which lies in the vicinity of an end thereof, a driving blade disposed at a distal end portion of the handle and adapted to drive out a wire staple in the magazine towards the clincher in association with rotation of the handle, and furthermore, a table having a clincher surrounding portion and adapted to cause the clincher surrounding portion to ascend or descend relative to the clincher, a slider made to slide in such a manner as to permit a descending action of the clincher surrounding portion at a predetermined timing in association with a clinching action of the table, and a slider pushing member fixed to the handle to cause the slider to slide through rotation of the handle.

In the stapler configured as has been described above, since when it is grabbed in such a manner as to shorten the distance between the handle and the base portion, the slider pushing member causes the slider to slide, a locking state between the table and the slider is released, whereby the table is allowed to descend, and a staple is pressed between the driving blade and the clincher in such a manner that distal ends of the staple are bent to fasten sheets of paper.

Staplers which are each made up of two members which can rotate a clincher are proposed in the Japanese Examined Utility Model Publication No. 63-43027 and the Japanese Examined Utility Model Publication No. 2-48229. In these staplers, when the distance between a handle and a base portion is shortened, the clincher rotates in such a manner that an upper portion of the clincher is made into a flat surface, so as to bend flat distal ends of a staple.

In addition, in such staplers, there are a hand-held type stapler which is used by being grabbed by the hand and a desktop type stapler. A basic construction of this desktop type stapler is substantially the same as that of the hand-held type stapler. However, the desktop type stapler is larger in size than the hand-held type stapler, and since when in use, the handle member is lowered by the weight of the user being applied thereto, a large number of sheets of paper can be fastened.

In the flat type stapler, when the slider is caused to slide to lower the clincher surrounding portion, since the clincher surrounding portion descends drastically, there is caused a problem that an impact is produced at the time of clinching, and this makes it difficult to effect clinching.

In addition, in the desktop type stapler, large force is necessary to fasten a large number of sheets of paper, and where the handle portion is made large to make use of the principle of the lever to reduce the force required for clinching for fastening such a large number of sheets of paper, the balance of the stapler is deteriorated due to the handle portion being too large, and this causes a problem that in the event that a strong force is applied to the handle portion, a rear end of the stapler is caused to float. Furthermore, where the base portion is made large to improve the balance of the stapler, there is also caused a problem that the stapler becomes large in size.

SUMMARY OF THE INVENTION

The invention has been made in view of the problems inherent in the related art that have been described above, and an object thereof is to provide a desktop type or hand-held type stapler which can fasten a large number of sheets of paper with a small force and in a smooth fashion.

With a view to attaining the object, according to an embodiment of the invention, there is provided a stapler including a base portion having a rotatable clinching portion, a magazine portion which is rotatably attached to a portion of the base portion which lies in the vicinity of a rear end thereof by means of a spindle, a push-down member which is rotatably attached to a portion of the base portion which lies in the vicinity of the rear end thereof in such a manner as to be disposed above the magazine portion and which has a driving blade in the vicinity of a front end thereof, handle supporting members which are fixed to the base portion and which have guide rails in which a handle shaft slides in the vicinity of front ends of upper portions thereof, and a handle portion which is rotatably attached to the push-down portion by means of a connecting shaft and which is rotatably attached by means of a handle shaft which can slide in the guide rails of the handle supporting members above the position where the driving blade is disposed, wherein the handle portion causes the push-down portion to descend by virtue of the principle of the lever with the handle shaft made to act as a movable fulcrum, a portion of the handle portion which lies in the vicinity of a rear end thereof as a point of application of force, and the connecting shaft as a point of action.

In addition, the guide rails of the handle supporting members may each have an ascending or descending inducing portion which extends forwards and downwards and a clinching inducing portion which extends forwards and slightly upwards from a lower end of the ascending or descending inducing portion.

Furthermore, a guide member made of a resin is provided directly above the guide rails of the handle supporting members, a lower surface of the guide member having an ascending or descending inducing surface whose cross sectional shape is substantially the same as that of the ascending or descending inducing portion and a clinching inducing surface whose cross sectional shape is substantially the same as that of the clinching inducing portion of the guide rail, and is disposed in such a manner that the lower surface of the guide member projects slightly into the guide rails from upper edges of the guide rails, so as to cause the handle shaft to slide along the lower surface of the guide member.

With the In this stapler of the present invention, by adopting the construction in which the handle portion is rotatably attached above the position where the push-down portion and the driving blade are disposed by means of the connecting shaft and which is rotatably attached by means of the handle shaft which can slide in the guide rails of the handle supporting members, so as to cause the push-down portion to descend by virtue of the principle of the lever with the handle shaft made to act as the fulcrum, the portion of the handle portion which lies in the vicinity of the rear end thereof as the point of application of force, and the connecting shaft as the point of action, not only can the principle of the lever be made use of to ensure an optimum assist ratio which is a load reduction ratio, but also the positional relationship between the fulcrum, the point of application of force and the point of action can be made constant at all times, thereby making it possible to make constant at all times the assist ratio at the time of clinching.

In addition, by forming the guide rails of the handle supporting members into the shape which has the ascending or descending inducing portion which extends forwards and downwards and the clinching inducing portion which extends forwards and slightly upwards from the lower end of the ascending or descending inducing portion, a pushing down distance required at the time of clinching can be secured while maintaining the assist ratio constant.

Furthermore, by causing the handle shaft to slide along the guide member made of resin, not only can the wear of metal be prevented but also the frictional force can be weakened, and consequently, not only can clinching be attained with a weak force but also the durability of the stapler can be enhanced.

DESCRIPTION OF THE PREFERRED EMBODIMENT

Figure 1:
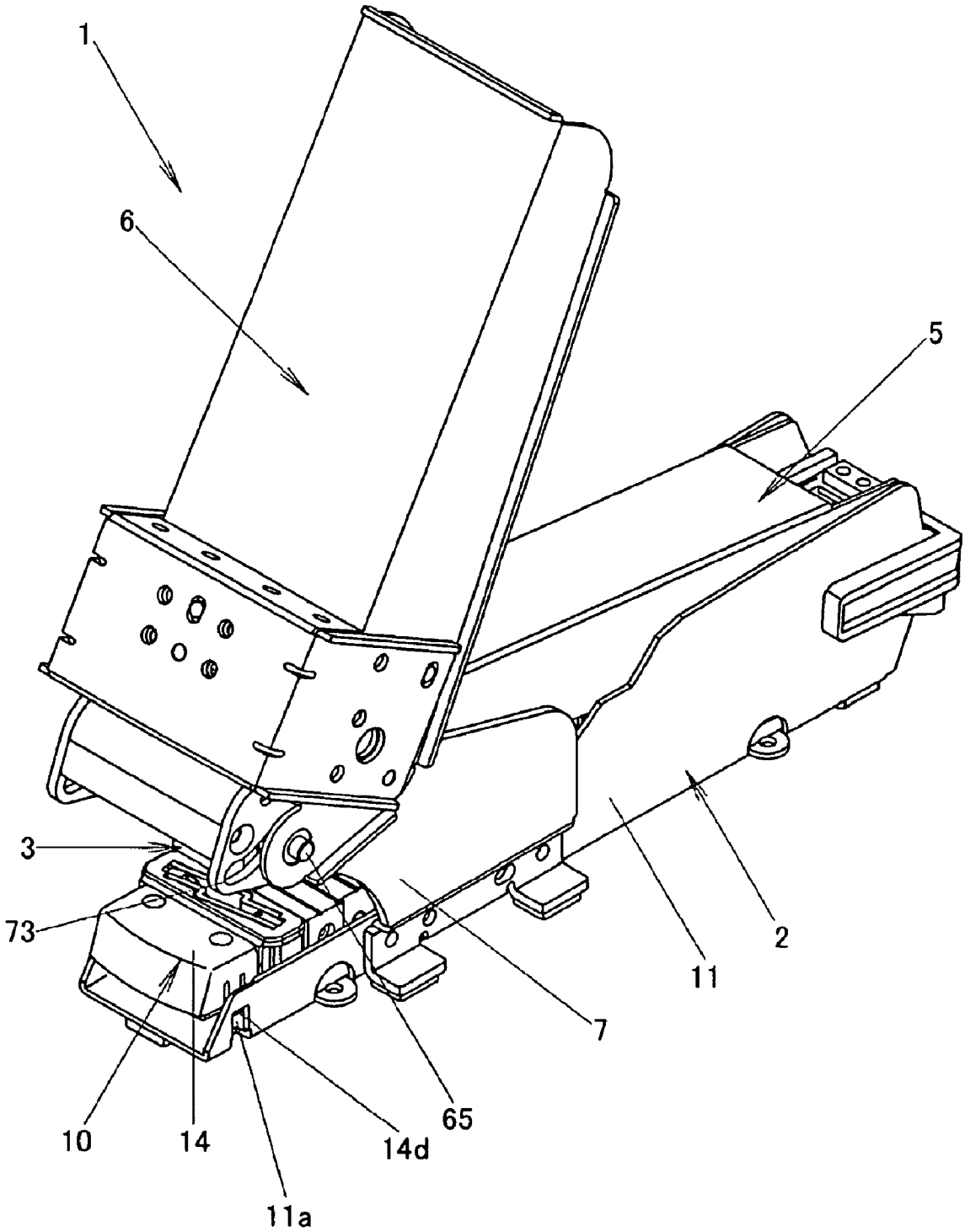
FIG. 1 is a perspective view of a stapler according to an embodiment of the invention which is seen from the left front.

A stapler 1 according to a best mode for carrying out the invention is such as to include a base portion 2 which has a rotatable clinching portion 10, a magazine portion 3 of a front-loading type which is disposed above the base portion 2, a push-down portion 5 which is disposed above the magazine portion 3, handle supporting members 7 which are fixed to the base portion 2 and which have guide rails 73 in the vicinity of front ends of upper portions thereof, and a handle portion 6 which is disposed above the push-down portion 5 by the handle supporting members 7.

In addition, the magazine portion 3 and the push-down portion 5 of the stapler 1 are rotatably attached to a portion of the base portion 2 which lies in the vicinity of a rear end thereof by means of a spindle 25, and the handle portion 6 is rotatably attached to the handle supporting members in a position lying in the vicinity of a front end thereof by means of a handle shaft 65 which can slide along the guide rails 73 of the handle supporting members 7 and is rotatably attached to a portion of the push-down portion 5 which lies in the vicinity of a front end of an upper portion of the push-down portion 5 in a position which lies slightly further rearwards than the handle shaft 65 by means of a connecting shaft 66. Then, this handle portion 6 causes the push-down portion 5 to descend by virtue of the principle of the lever with the portion which is rotatably attached to the handle supporting members 7 made to act as a movable fulcrum, a rear end portion as a point of application of force and a portion which is rotatably attached to the push-down portion 5 as a point of action of force.

In addition, the guide rails 73 of the handle supporting members 7 have each an ascending or descending inducing portion 73*a* which extends forwards and downwards, and a clinching inducing portion 73*b* which extends forwards and slightly upwards from a lower end of the ascending or descending inducing portion 73*a*.

Furthermore, guide member 75 made of plastic are provided directly above the guide rails 73 of the handle supporting members 7, and a lower surface of the guide member 75 includes an ascending or descending inducing surface 75*a* whose sectional shape is substantially the same as that of the ascending or descending inducing portion 73*a* of the guide rail 73 and a clinching inducing surface 75*b* whose sectional shape is substantially the same as that of the clinching inducing portion 73*b*. The handle supporting members 7 are disposed in such a manner that the lower surface of the guide member 75 projects slightly into the guide rails 73 from upper edges of the guide rails 73, so as to cause the handle shaft 65 to slide along the lower surface of the guide member 75.

In addition, a leaf spring 45 which has a driving blade 46 and a damper spring 49 are disposed between the magazine portion 3 and the push-down portion 5, and the leaf spring 45 has slider thrusting portions 47 which are adapted to be locked on sliding support portions 13*a* formed on a slider 13 of the clinching portion 10 provided on the base portion 2, whereby the slider thrusting portions 47 move rearwards in association with deflection of the leaf spring 45 so as to move the sliding support portion 13*a* rearwards, this causing the slider 13 to slide rearwards to enable clinching.

Figure 2:
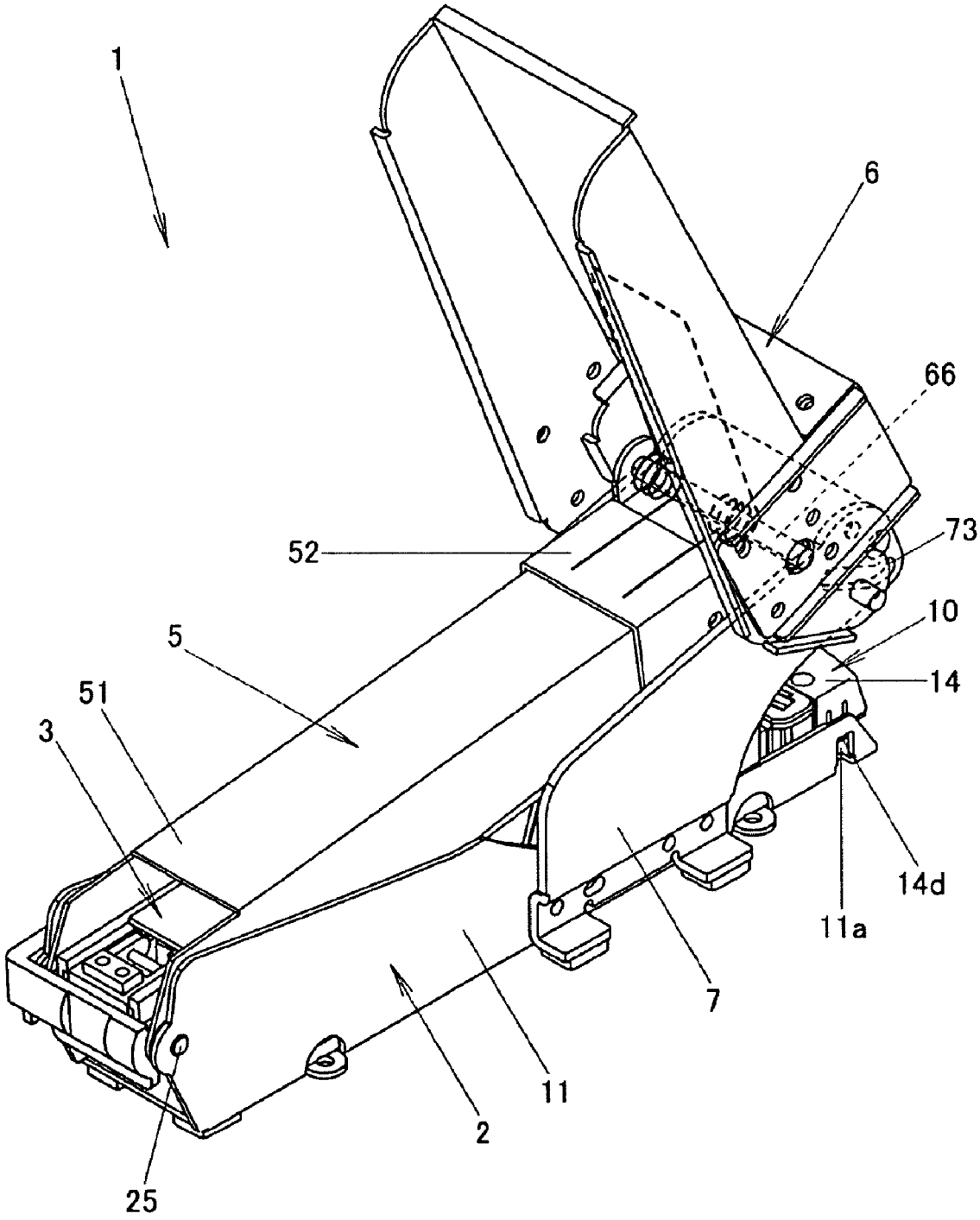
FIG. 2 is a perspective view of the stapler according to the embodiment of the invention which is seen from the right rear.
Figure 3:
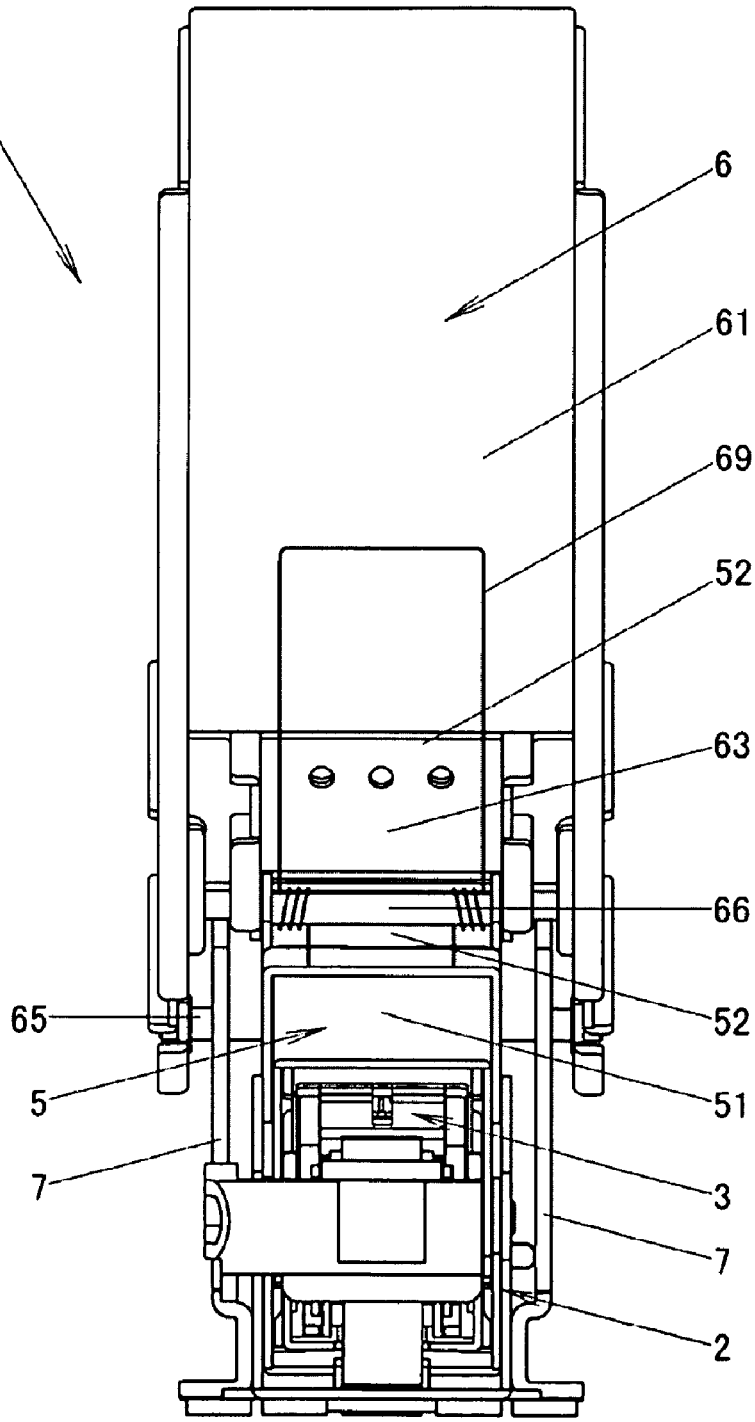
FIG. 3 is a plan view of the stapler according to the embodiment of the invention.

Hereinafter, an embodiment of the invention will be described based on the drawings. As is shown in FIGS. 1 to 3, a stapler 1 of the embodiment is a desktop type stapler for fastening a bundle of two to on the order of sixty sheets of paper with a staple driven or bent flat after it has penetrated and fastened so many sheets of paper and includes a base portion 2 which has a rotatable clinching portion 10, a magazine portion 3 of a front-loading type which is disposed above the base portion 2, a push-down portion 5 which is disposed above the magazine portion 3, handle supporting members 7 which are fixed to the base portion 2 and which have guide rails 73 in the vicinity of front ends of upper portions thereof, and a handle portion 6 which is disposed above the push-down portion 5 by the handle supporting members 7.

In addition, the magazine portion 3 and the push-down portion 5 of the stapler 1 are rotatably attached to a portion of the base portion 2 which lies in the vicinity of a rear end thereof by means of a spindle 25, and the handle portion 6 is rotatably attached to the handle supporting members in a position lying in the vicinity of a front end thereof by means of a handle shaft 65 which can slide along the guide rails 73 of the handle supporting members 7 and is rotatably attached to a portion of the push-down portion 5 which lies in the vicinity of a front end of an upper portion of the push-down portion 5 in a position which lies slightly further rearwards than the handle shaft 65 by means of a connecting shaft 66. Then, this handle portion 6 causes the push-down portion 5 to descend by virtue of the principle of the lever with the portion which is rotatably attached to the handle supporting members 7 made to act as a movable fulcrum, a rear end portion as a point of application of force and a portion which is rotatably attached to the push-down portion 5 as a point of action of force.

Figure 4:
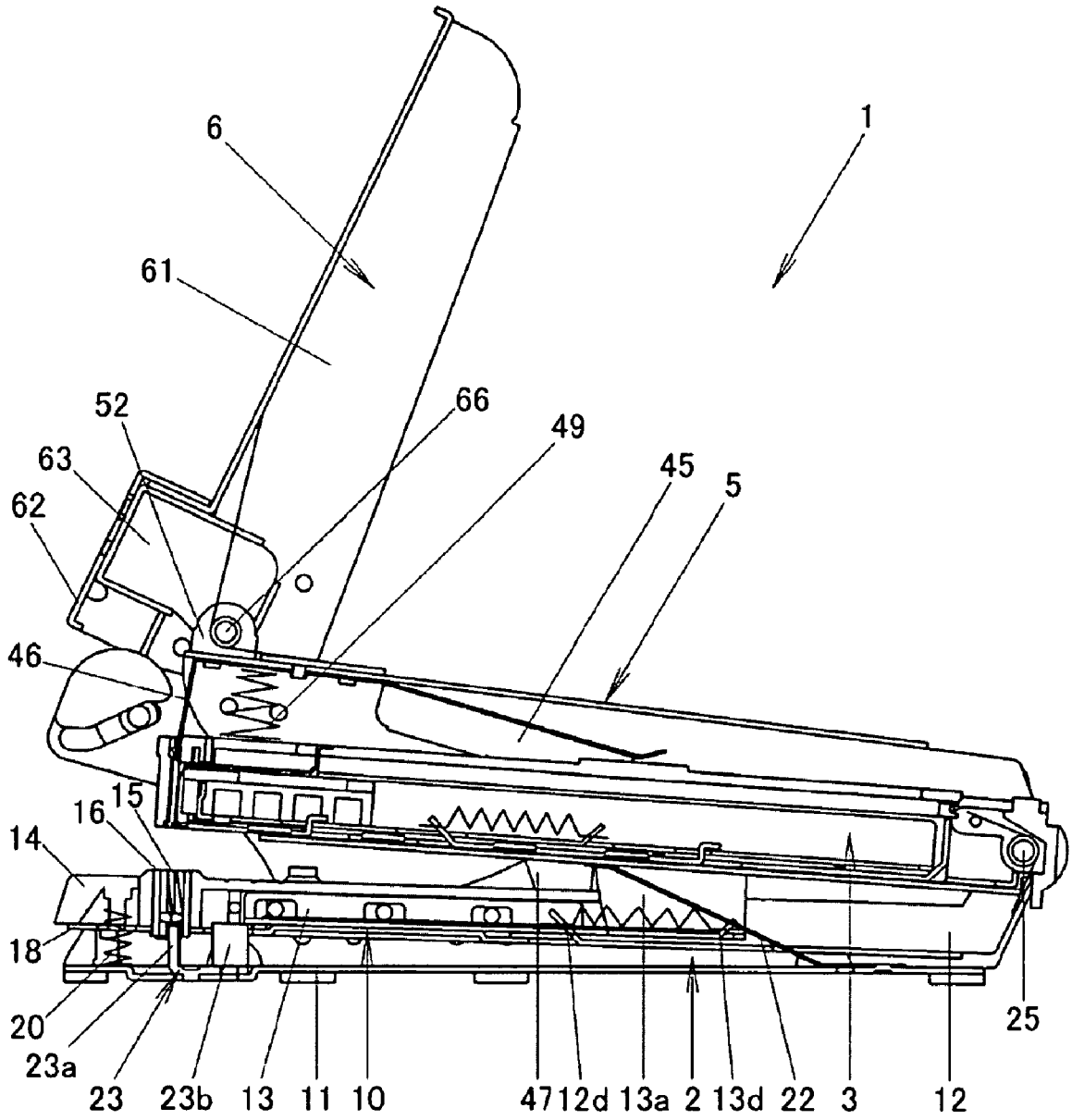
FIG. 4 is a sectional view of the stapler according to the embodiment of the invention.

Furthermore, in the stapler 1, as is shown in FIG. 4, a leaf spring 45 including a driving blade 46 and a damper spring 49 which is formed by a helical compression spring are disposed between the magazine portion 3 and the push-down portion 5, and slider thrusting portions 47 are formed on the leaf spring 45 in such a manner as to extend downwards therefrom, whereby when the slider thrusting portions 47 cause a slider 13 provided on the clinching portion 10 provided on the base portion 2 to move rearwards, the clinching portion 10 is permitted to descend so as to clinch a wire staple between the driving blade 46 and a movable clincher 15 to thereby bend distal ends of the wire staple horizontally.

In addition, the base portion 2 is made up of a pedestal member 11 which constitutes a pedestal of the stapler 1 and the clinching portion 10 which is rotatably attached to a portion of the pedestal member 11 which lies in the vicinity of a rear end thereof by the spindle 25.

Figure 5:
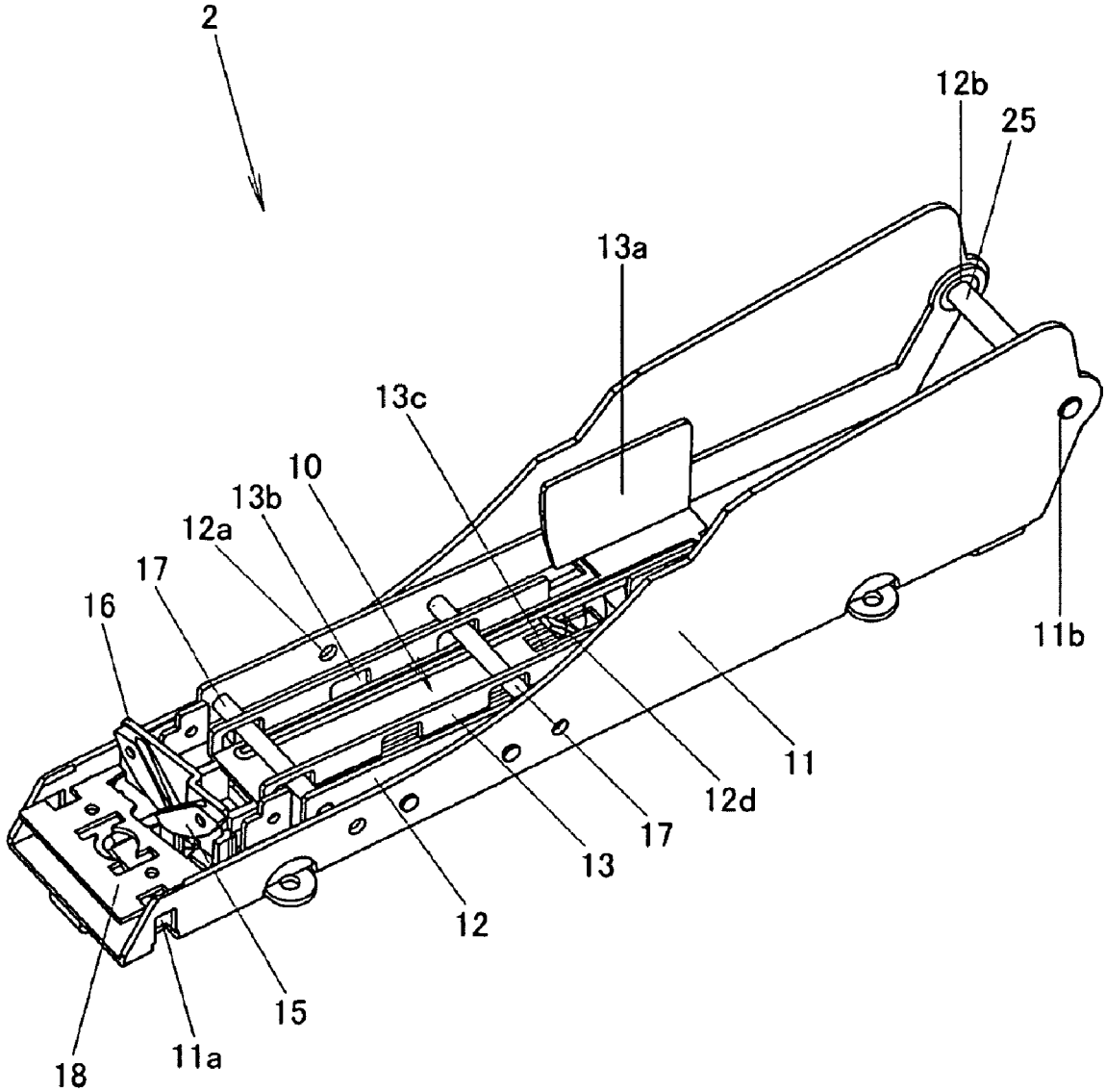
FIG. 5 is a perspective view of a base portion of the stapler according to the embodiment of the invention which is shown by removing other constituent members of the stapler.

This pedestal member 11 is a member which constitutes a base of the stapler 1 in this embodiment, and the magazine portion 3 and the push-down portion 5 are rotatably attached to the pedestal member 11 in a position lying in the vicinity of a rear end thereof. The pedestal member 11 is, as is shown in FIG. 5, is made up of an elongated rectangular flat plate and side walls which rise vertically from both side ridge portions of the flat plate.

The side walls of the pedestal member 11 are formed high towards rear ends thereof and in such a manner as to become lower as they extend towards leading ends thereof and each have a locking hole 11*a* in the vicinity of the leading end thereof and a shaft hole lib in the vicinity of the rear end thereof. As is shown in FIGS. 1 and 2, this locking hole 11*a* is a hole through which a stop claw 14*d* of a table 14, which will be described later, is passed, and the shaft hole lib is, as is shown in FIG. 5, a hole through which the spindle 25 is passed by which the clinching portion 10 and the like are rotatably attached.

In addition, a locking member 23, shown in FIG. 4, is fixed in the vicinity of a front end of the flat plate of the pedestal member 11. This locking member 23 is made up of a clincher locking portion 23*a* which projects vertically from a front end ridge portion of a quadrangular flat plate and slider locking portions 23*b* which project vertically from both side ridge portions of the flat plate in positions lying in the vicinity of a rear end thereof. In addition, the clincher locking portion 23*a* is such as to be locked on the movable clincher 15, which will be described later, from below so as to rotate the movable clincher 15 upwards, and the slider locking portions 23*b* are made to be locked on the slider 13 to prevent the clinching portion 10 from descending and to be released from the locked state with the slider 13 when the slider 13 slides rearwards to enable the clinching portion 10 to descend.

Furthermore, one end of a table biasing spring 20, which is made up of a helical compression spring, is attached to a portion of the flat plate of the pedestal member 11 which lies in the vicinity of a distal end portion thereof, and one end of a magazine biasing spring 22, which is made up of a leaf spring, is attached to a portion of the flat plate which lies in the vicinity of the rear thereof.

As is shown in FIGS. 4 and 5, the clinching portion 10 is such as to include a slider holding member 12 which is rotatably attached to the pedestal member 11 by the spindle 25, the slider 13 which is disposed on the slider holding member 12 in such a manner as to slide backwards and forwards, the table 14 which is fitted in the slider holding member 12, the movable clincher 15 disposed in the vicinity of a distal end of the slider holding member 12 and a clincher holding member 16 which holds the movable clincher 15 and a table distal end cover member 18 which is fixed to the distal end of the slider holding member 12.

Figure 6:
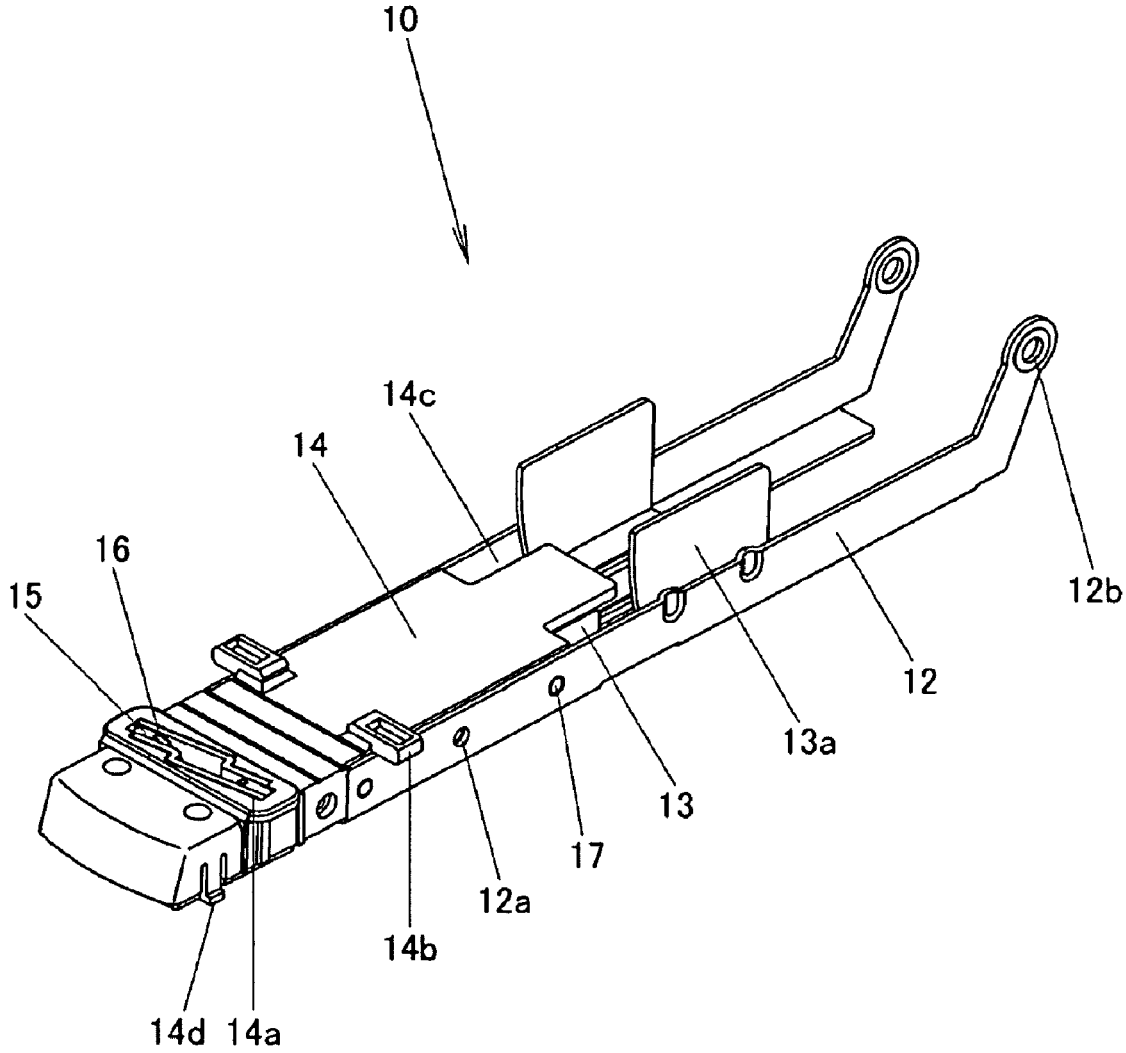
FIG. 6 is a perspective view of a clinching portion of the stapler according to the embodiment of the invention.

The slider holding member 12 is a member on which the slider 13 and the table 14 are disposed and is made up of an elongated rectangular flat plate and side walls which rise vertically from both side ridge portions of the flat plate. The slider holding member 12 is rotatably attached to the pedestal member 11 at a rear end thereof by the spindle 25. In addition, as is shown in FIG. 6, the side walls of the slider holding member 12 are formed in such a manner as to extend rearwards and obliquely upwards at the rear and each have a plurality of shaft fixing holes 12*a* from the vicinity of a front end to the vicinity of a center thereof and a shaft hole 12*b* in the vicinity of the rear end thereof. These shaft fixing holes 12*a* are holes in which a sliding support shaft 17, which will be described later, is fixed, and the shaft hole 12*b* is a hole through which the spindle 25 shown in FIG. 5 is passed.

In addition, as is shown in FIG. 4, the slider holding member 12 has a through hole through which the slider locking portion 23*b* of the locking member 23 which is fixed to the pedestal member 11 is passed in the vicinity of the distal end of the flat plate and a spring attaching projection 12*d* to which a tension spring is attached in such a manner as to extend between a spring attaching projection 13*d* of the slider 13, which will be described later, and itself in the vicinity of a rear end of the flat plate.

The slider 13 is such as to permit a descending action of the clinching portion 10, and this slider 13 is, as is shown in FIG. 5, made up of an elongated substantially quadrangular flat plate, side walls which rise vertically from both side ridge portions of the flat plate and sliding support portions 13*a* which rise vertically from both the side ridge portions of the flat plate in positions lying in the vicinity of rear ends of the side walls. In addition, the flat plate of the slider 13 is formed wider at a rear part where the sliding support portions 13*a* are formed than a front part where the side walls are formed, and the sliding support portions 13*a* are formed further outwards than the side walls. The reason that the part of the flat plate where the sliding support portions 13*a* are formed is formed wider in this way is that as is shown in FIG. 4, since the slider thrusting portions 47 of the leaf spring 45, which will be described later, are situated further outwards than both the side walls of the slider 13, the sliding support portions 13*a* need to be situated further outwards than the side walls of the slider 13 for realizing a locking engagement of the slider thrusting portions 47 with the sliding support portions 13*a*.

In addition, a front end face of the sliding support portion 13*a*, which is a surface against which the slider thrusting portion 47 is locked, is formed into a curved surface. The reason that the front end face of the sliding support portion 13*a* is formed into the curved surface in this way is that since the stapler 1 of the embodiment is the stapler which fastens a bundle of two to on the order of sixty sheets of paper and a position where a front end of a lower portion of the magazine portion 3, which will be described later, is brought into contact with an upper surface of a sheet of paper lying on the top of the bundle of sheets differs depending upon the number of sheets to be fastened, a position where the slider thrusting portions 47 of the leaf spring 45 start to move rearwards also differs accordingly.

Consequently, to have substantially the same timing at which clinching takes place irrespective of the thickness of a bundle of sheets to be placed on the table 14, it is necessary that the timing at which the slider thrusting portions 47 cause the slider 13 to slide rearwards is not affected by the thickness of a bundle of sheets to be placed on the table 14. Then, by forming the front end face of the sliding support portion 13*a* which constitutes the surface against which the slider thrusting portion 47 is locked is formed into the curved shape which corresponds to the thickness of a bundle of sheets to be fastened. Accordingly, the position where the slider thrusting portion 47 and the front end face of the sliding support portion 13*a* are brought into contact with each other is made to change by the thickness of a bundle of sheets to be placed on the table 14, so that the timing at which the slider thrusting portion 47 moves rearwards becomes substantially the same at all times even when the thickness of a bundle of sheets changes.

In addition, the slider 13 has, as is shown in FIG. 5, a plurality of longitudinally long shaft moving holes 13*b* in each of the side walls from the vicinity of a front end towards the vicinity of a center thereof, as well as a through hole 13*c* in the vicinity of a rear end of the flat plate. These shaft moving holes 13*b* are holes through which the sliding support shafts 17 are passed, and the length of the shaft moving hole 13*b* is made to be a length which is substantially the same as a distance over which the slider 13 is allowed to slide, and the through hole 13*c* is a hole through which the spring attaching projection 12*d* of the slider holding member 12 is passed.

The reason that the sliding support shaft 17 is passed through the shaft moving hole 13*b* in this way is that since the stapler of the embodiment is of the desktop type, the stapler 1 becomes larger in size than a hand-held one, and in the case of the large-sized stapler like this, since a distance over which the slider 13 slides becomes long, there may be caused a case where the slider 13 oscillates while it is sliding, whereby a smooth rearward sliding of the slider 13 is interrupted or a case where a load generated at the time of clinching is increased due to friction between the flat plate of the slider 13 and the table 14. However, by passing the sliding support shaft 17 through the shaft moving hole 13*b* to cause the sliding support shaft 17 to assist the sliding of the slider 13, the slider 13 is prevented from tilting while it is sliding, and this allows a gap to be produced between the flat plate of the slider 13 and the table 14 so as to reduce friction that is produced therebetween.

Furthermore, as is shown in FIG. 4, the spring attaching projection 13*d* is formed in the vicinity of the rear end of the flat plate of the slider 13. Then, the helical tension spring is attached to extend between the spring attaching projection 13*d* and the spring attaching projection 12*d* of the slider holding member 12, so as to bias the slider 13 to the front.

In addition, when the slider 13 is being situated at the front, the slider locking portions 23*b* of the locking member 23 are locked on a lower surface of the flat plate of the slider 13, whereby the clinching portion 10 is disabled from descending. However, when the slider 13 slides to the rear and the front end of the flat plate arrives at a position lying further rearwards than the slider locking portions 23*b* of the locking member 23, the locking of the slider locking portions 23*b* and the lower surface of the flat plate of the slider 13 is released, whereby the clinching portion 10 is enabled to descend.

The table 14 is where sheets of paper to be fastened are placed, and as is shown in FIG. 6, has a quadrangular flat plate 14*g* which includes the movable clincher 15 in the vicinity of the front end thereof, a front wall 14*h* which is formed in such a manner as to extend forwards and obliquely downwards from a front end ridge portion of the flat plate 14*g* and side walls 14*i* which are suspended from both side ridge portions of the flat plate 14*g* in positions lying in the vicinity of a front end of the flat plate. The table 14 is fitted in the slider holding member 12.

In addition, the table 14 has a clincher surrounding portion 14*a* which is formed in the vicinity of a distal end of the flat plate, stop projections 14*b* which are formed in such a manner as to project outwards from both side edges of the table 14 in the vicinity of the rear of the clincher surrounding portion 14*a*, and cut-outs 14*c* which are formed in the vicinity of a rear end of the table 14. The table 14 also has a spring attaching projection, not shown, on a rear surface thereof in the vicinity of a distal end portion thereof.

This clincher surrounding portion 14*a* is an opening which is formed into substantially the same shape of an external configuration of the clincher holding member 16 which holds the movable clincher 15 so that a portion of the clincher holding member 16 which lies in the vicinity of an upper end thereof is fitted therein. In addition, the stop projections 14*b* are such as to be locked on upper sides of the side walls of the pedestal member 11, respectively, when the clinching portion 10 descends so as to stop the descending action of the clinching portion 10. Furthermore, the cut-outs 14*c* are portions where the slider thrusting portions 47 of the leaf spring 45, which will be described later, fit in, respectively, and an end portion of the table biasing spring 20 shown in FIG. 4 is attached to the spring attaching projection.

Furthermore, the stop claws 14*d* are formed on the side walls of the table 14 in the vicinity of front ends of the walls, and these stop claws 14*d* are, as is shown in FIGS. 1 and 2, passes through the locking holes 11*a* in the pedestal member 11, so that when the clinching portion 10 is rotated upwards by the table biasing spring 20 shown in FIG. 4, the stop claws 14*d* are locked on upper ends of the locking holes 11*a* so as to prevent a further upward rotation of the clinching portion 10.

As is shown in FIG. 6, the movable clincher 15 is such as to be disposed within the clincher surrounding portion 14*a* in the table 14 in such a state that the movable clincher 15 is rotatably attached to the clincher holding member 16, and is made up of two clinching members which are each formed into a thick elongated substantially rectangular shape. As is shown in FIG. 5, this clinching member has a pressing surface on an upper side thereof in which a rail is formed and when a distal end of a wire staple is pressed against the pressing surface thereof, the clinching member is made to bend the distal end of the wire staple along the rail.

In addition, when the clinching portion 10 is disabled from descending due to the slider 13 and the slider locking portions 23*b* of the locking member 23 being locked on each other, the movable clincher 15 is accommodated in an interior of the clincher holding member 16, while when the clinching portion 10 descends as a result of the locking between the slider 13 and the slider locking portions 23*b* of the locking member 23 being released, the distal end of the movable clincher 15 is brought into contact with the clincher locking portion 23*a* of the locking member 23 to thereby be pushed upwards, whereby the movable clincher 15 rotates within the interior of the clincher holding member 16, and the pressing surface is made parallel to an upper surface of the table 14.

In addition, the movable clincher 15 is mounted in the clincher holding member 16 in such a state that the movable clincher 15 is rotated through about 9 degrees relative to a lateral axis which intersects a longitudinal axis of an upper surface of the flat plate of the table 14 at right angles.

The reason that the movable clincher 15 is mounted in the clincher holding member 16 in such a state that the movable clincher 15 is rotated slightly relative to the lateral axis in this way is that since the staple of the embodiment is such as to fasten a bundle of two to on the order of sixty sheets of paper, when the movable clincher 15 is mounted in parallel with the lateral axis, in the event that a thin bundle of two to on the order of twenty-five sheets of paper is attempted to be fastened using a wire staple having long legs suitable for fastening a thick bundle of on the order of sixty sheets of paper, there may be caused a fear that distal ends of the wire staple intersects each other due to the legs being too long for the thin bundle of so many sheets of paper, and hence the intersection of the distal ends of the wire staple can be prevented even when such a small number of sheets of paper is fastened with the wire staple which has such long legs.

In addition, although conventionally, staples having legs of different lengths have had to be used when attempting to fasten two to thirty sheets of paper and thirty to sixty sheets of paper, by mounting the movable clincher 15 in the clincher holding member 16 in such a state that the movable clincher 15 is rotated slightly relative to the lateral axis, clinching can continuously be implemented using the same kind of wire staples at all times.

The clincher holding member 16 is made up of two plates which each have a wide portion where the width is made wide and a narrow portion where the width is made narrow and which are each formed into a hook-like shape in lateral cross section. In addition, the two plates are disposed in such a manner that the wide portion of one plate confronts the narrow portion of the other plate, and the movable clincher 15 is rotatably attached between the two plates. Additionally, the width of the wide portion is made substantially the same as a longitudinal length of the pressing surface of the movable clincher 15.

Furthermore, the clincher holding member 16 is mounted in the clincher surrounding portion 14*a* of the table 14 in such a state that the clincher holding member 16 is slightly rotated thereto so that when the clincher holding member 16 holds the movable clincher 15, the movable clincher 15 clincher is rotated through about 9 degrees relative to the lateral axis of the table 14, and the movable clincher 15 is rotatably attached to the clincher holding member 16 in such a manner that when the two clinching members are rotated, portions lying in the vicinity of distal end portions of surfaces which intersect the pressing surface at right angles overlap each other.

The table distal end cover member 18 is made up of a flat plate having an opening, and as is shown in FIG. 4, the table distal end cover member 18 allows the table biasing spring 20 to pass therethrough. In addition, the table distal end cover member 18 is disposed at the distal end of the slider holding member 12, so as to close a portion on a rear surface side of the table 14 which lies in the vicinity of a distal end portion thereof.

The table biasing spring 20 is made up of a helical compression spring, and one end thereof is fixed to the vicinity of the front end of the flat plate of the pedestal member 11, while the other end thereof is fixed to the spring attaching projection on the table 14 after it has passed through the opening in the table distal end cover member 18, so as not only to bias the clinching portion 10 upwards but also to absorb impact when the clinching portion 10 descends.

The magazine biasing spring 22 is a leaf spring which is fixed to the vicinity of the rear end of the flat plate of the pedestal member 11 at one end thereof and is disposed close to a rear surface of a magazine main body 31, which will be described later, at the other end thereof and is made to bias the magazine portion 3 upwards.

Figure 7:
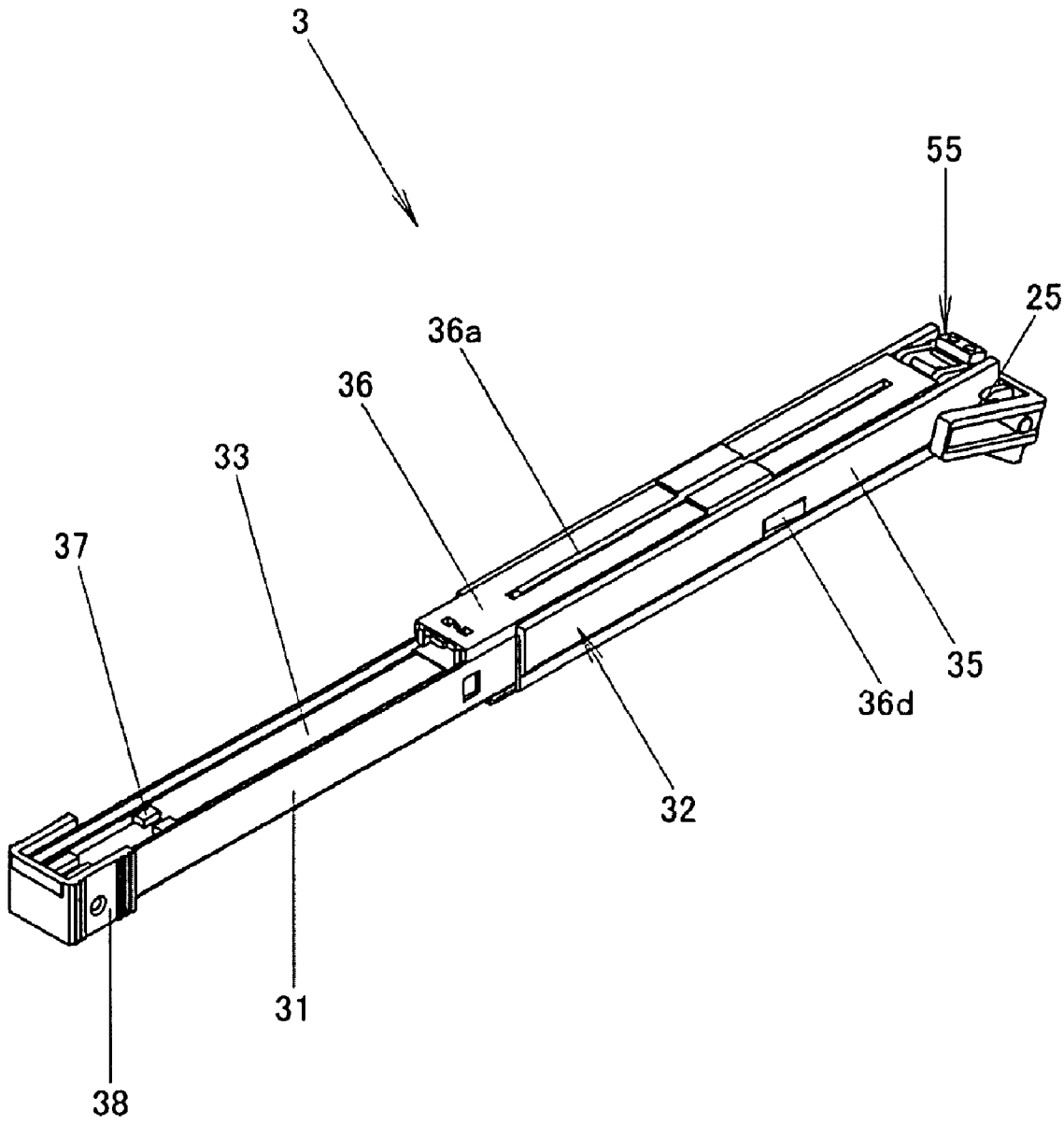
FIG. 7 is a perspective view of a magazine portion of the stapler according to the embodiment of the invention which shows a magazine main body projecting therefrom.

In addition, the magazine portion 3 of the embodiment includes, as is shown in FIG. 7, the magazine main body 31, which is slidable, a magazine accommodating portion 32 which accommodates the magazine main body 31, and a magazine main body locking mechanism which locks or releases a rear end of the magazine main body 31. The magazine portion 3 is of a front-loading type in which wire staples are loaded to be accommodated in the magazine main body 31 by pulling out the magazine main body 31 to the front. In addition, wire staples which are accommodated in the magazine main body 31 are U-shaped wire staples which each include a crown and two legs which are suspended from both ends of the crown, and a plurality of wire stales are connected into a bundle of wire staples for accommodation in the magazine main body 31.

The magazine main body 31 includes an elongated rectangular flat plate which is formed slightly wider than the width of wire staples, side walls which rise vertically from both side ridge portions of the flat plate, a front wall which is formed by bending distal end portions of the side walls substantially at right angles towards the inside and a rear wall which is formed by forming two cuts in the vicinity of the side ridge portions at a rear end of the flat plate in such a manner as to be parallel to the side walls and raising vertically a portion of the flat plate which lies between the two cuts so formed, and a gripping member 38 adapted to be gripped when pulling out the magazine main body 31 from the magazine accommodating portion 32 is mounted on the magazine main body 31 in the vicinity of the front wall. In addition, openings are formed in both the side walls of the magazine main body 31 in the vicinity of centers thereof in such a manner as to be locked on stoppers 36*d* on a magazine lid 36, which will be described later.

Figure 8:
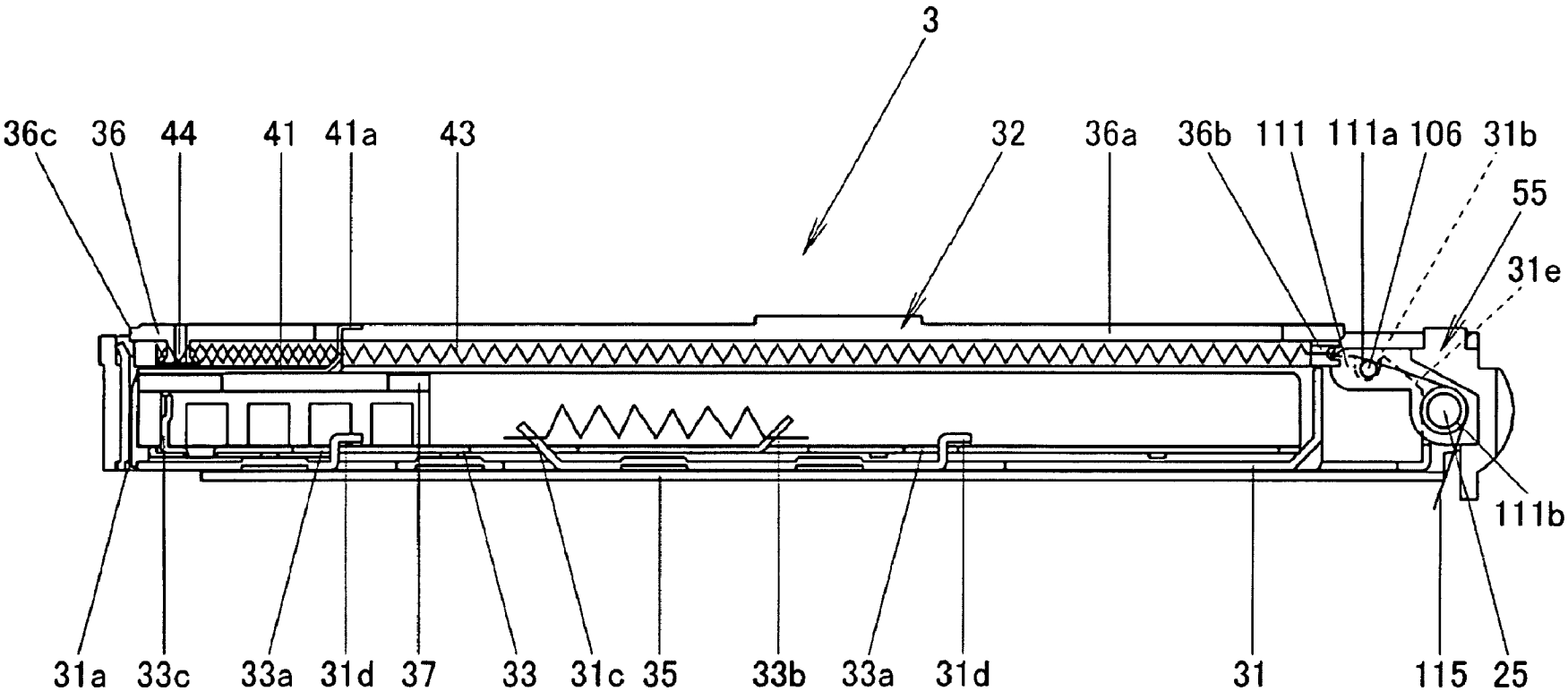
FIG. 8 is a sectional view of the magazine portion of the stapler according to the embodiment of the invention.

In addition, as is shown in FIG. 8, the magazine main body 31 has a drive-out port 31*a* which is formed between the front end of the flat plate and the front wall, rear end locking grooves 31*b* which are formed on upper portions of the side walls in the vicinity of the rear ends thereof, and tapered portions 31*e* which are provided in such a manner as to extend rearwards and obliquely downwards from rear ends of the rear end locking grooves 31*b*. This drive-out port 31*a* is a hole through which wire staples accommodated within the magazine main body 31 pass when they are driven downwards by the drive blade 46, and the rear end locking grooves 31*b* and the tapered portions 31*e* are such as to lock or induce the operation of a rear end locking member 55, which will be described later.

Furthermore, the magazine main body 31 includes a fixing claw 31*d* and a spring locking projection 31*c* on the flat plate. This fixing claw 31*d* is such as to pass through a through hole 33*a* formed in a flat plate of a sliding assist member 33, which will be described later, so as to be locked on a rear end of the through hole 33*a*, and the spring locking projection 31*c* is where one end of a helical tension spring is attached which is mounted to extend between a spring locking projection 33*b* of the sliding assist member 33 and itself.

The sliding assist member 33 is a member which assists the sliding of wire staples accommodated in the magazine main body 31 and sliding of a staple thrusting member 41 possessed by a staple thrusting mechanism and which is used to remove a wire staple which is trapped in the drive-out port 31*a* of the magazine main body 31. In addition, the sliding assist member 33 is such as to include an elongated rectangular flat plate whose width is made slightly narrower than the width of wire staples, side walls which rise vertically from ridge portions of the flat plate and a front locking wall 33*c* which rises vertically from a front end of the flat plate. In addition, front ends of the side walls of the sliding assist member 33 project further forwards than the front locking wall 33*c*, and front ends of upper portions of the side walls are tapered or formed into a curved shape.

In addition, the sliding assist member 33 has the through hole 33*a* and the spring locking projection 33*b* on the flat plate. The through hole 33*a* is a hole through which the fixing claw 31*d* formed on the flat plate of the magazine main body 31 is passed, and the spring locking projection 33*b* is where the one end of the helical tension spring is attached. Furthermore, sliding tabs 37, adapted to be attached to the front locking wall 33*c* are fixed to the sliding assist member 33 in a position lying in the vicinity of a distal end portion thereof.

Then, the sliding assist member 33 is disposed on the flat plate of the magazine main body 31 in such a manner that the flat plate of the sliding assist member 33 is superposed thereon, whereby the fixing claw 31*d* of the magazine main body 31 passes through the through hole 33*a* and the helical tension spring is attached to the spring locking projections 31*c*, 33*b* of the magazine main body 31 and the sliding assist member 33, respectively, thereby the sliding assist member 33 being biased to the front within the magazine main body 31. In addition, gaps are formed between the side walls of the magazine main body 31 and the side walls of the sliding assist member 33, and wire staples and the staple thrusting member 41, which will be described later, are allowed to slide along the sliding assist member 33 by legs of the wire staples and side walls of the staple thrusting member 41 fitting in the gaps.

Furthermore, when the driving blade 46 drives a leading wire staple of a bundle of wire staples accommodated within the magazine main body 31 downwards, since the driving blade 46 drives downwards a wire staple situated in a leading position of the bundle of wire staples downwards, a shearing force acts on the bundle of wire staples between the front ends of the upper portions of the side walls of the sliding assist member 33 and the driving blade 46, whereby the leading wire staple is separated from the bundle of wire staples and the wire staple so separated is then sent downwards along the tapered or curved portions which are situated at the front ends of the upper portions of the side walls of the sliding assist member 33. When the driving blade 46 is thrust further downwards, the wire staple is sent further downwards while held between an inner side of the magazine main body 31 and the front ends of the side walls of the sliding assist member 33. As this occurs, since the sliding assist member 33 is biased to the front by the helical tension spring, even though wire staples whose thicknesses are different (0.5 mm to 0.7 mm) are used, the holding force is adjusted through biasing by the helical tension spring so as to reduce the probability that a wire staple is trapped. Note that should a wire staple be trapped in the drive-out port 31*a*, the wire staple so trapped can easily be removed by moving the sliding tabs 37 backwards and forwards.

As is shown in FIG. 7, the magazine accommodating portion 32 is made up of a magazine receiving member 35 into which the magazine main body 31 slides and the magazine lid 36 in which the magazine receiving member 35 is fitted, and a staple thrusting mechanism is provided in a space surround by the magazine receiving member 35 and the magazine lid 36. This staple thrusting mechanism is a mechanism which thrust wire staples accommodated within the magazine main body 31 against a front end of the magazine main body 31.

The magazine receiving member 35 has an elongated rectangular flat plate 35*a* and side walls 35*b* which rise vertically from both side ridge portions of the flat plate 35*a* and is formed such that a front end of the flat plate 35*a* projects further forwards than front ends of the side walls 35*b*. In addition, the side walls 35*b* have shaft holes in the vicinity of rear ends thereof, and the magazine receiving member 35 is rotatably attached to the pedestal member 11 by the spindle 25. Furthermore, the side walls 35*b* have openings in the vicinity of centers thereof through which the stoppers 36*d* of the magazine lid 36 are passed.

Figure 9:
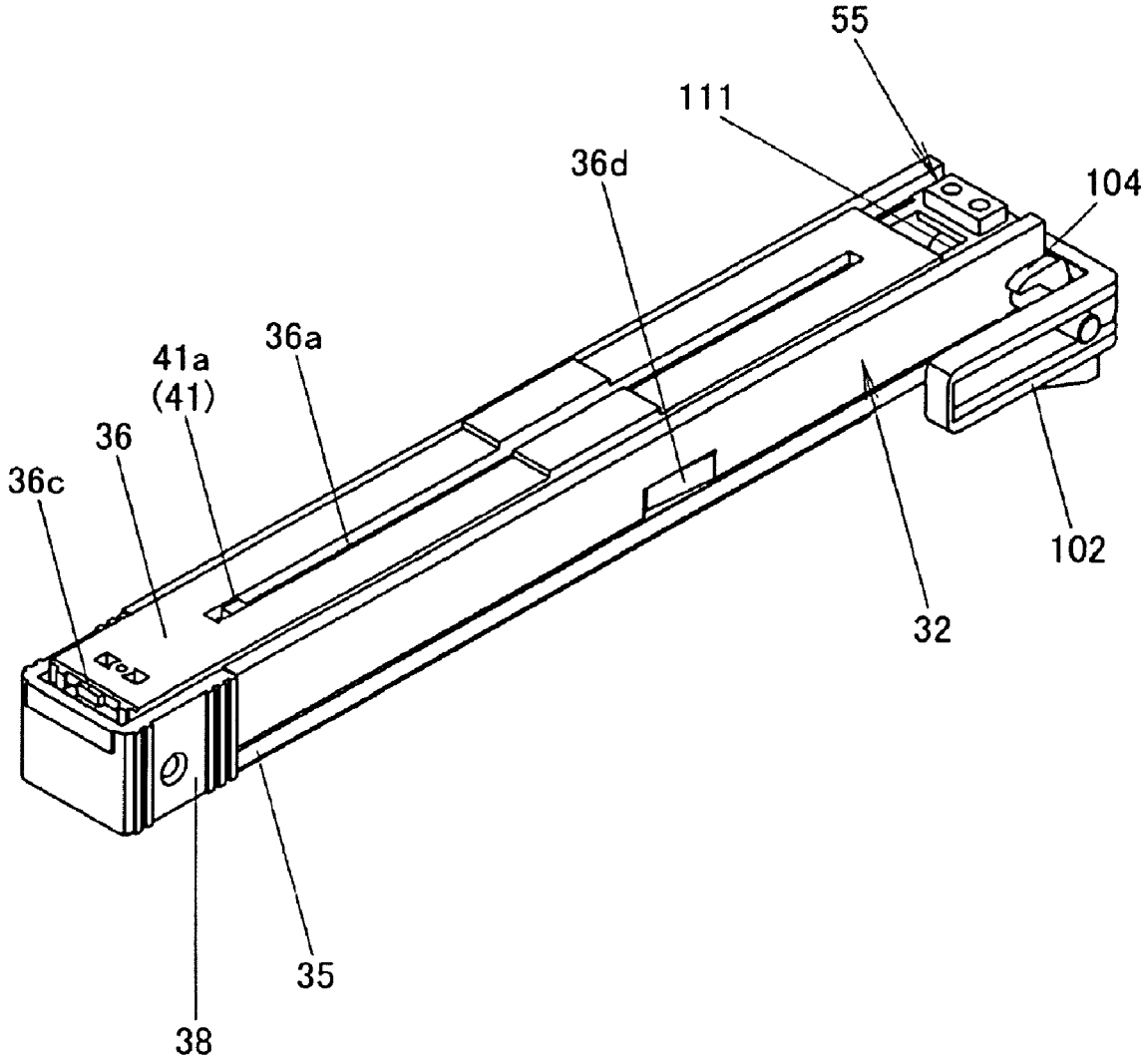
FIG. 9 is a perspective view of the magazine portion of the stapler according to the embodiment of the invention.

As is shown in FIG. 9, the magazine lid 36 has an elongated rectangular flat plate 36*e* and side walls 36*f* which are suspended respectively from both side ridge portions of the flat plate 36*e* and is formed such that a front end of the flat plate 36*e* projects further forwards than front ends of the side walls 36*f* and rear ends of the side walls 36*f* project further rearwards than a rear end of the flat plate 36*e*. The magazine lid 36 is fitted on the magazine receiving member 35 in such a manner that the side walls 35*b* of the magazine receiving member 35 are held by the side walls 36*f* of the magazine lid 36. In addition, a distal end portion of the flat plate 36*e* of the magazine lid 36 is situated above the gripping member 38 when the magazine main body 31 is accommodated in the magazine accommodating portion 32.

In addition, the flat plate 36*e* of the magazine lid 36 includes a cut-out 36*a* which is formed in a laterally central portion thereof from a position lying in the vicinity of the front end to a position lying in the vicinity of the rear end of the flat plate, and this cut-out 36*a* is a hole in which a sliding support piece 41*a* of the staple thrusting member 41, which will be described, slides. Furthermore, the stoppers 36*d* are formed on the side walls 36*f* of the magazine lid 36 in the vicinity of the centers thereof, and these stoppers 36*d* are locked in the openings formed in the side walls of the magazine main body 31 so as to prevent the magazine main body 31 from springing out of the magazine receiving portion 32 to the front.

Furthermore, the magazine lid 36 has a driving blade locking projection 36*c* which project from the front end of the flat plate, and as is shown in FIG. 8, the magazine lid 36 has a spring supporting member 44 which is fixed thereto in the vicinity of the front end and a spring attaching portion 36*b* in the vicinity of the rear end thereof, and shaft holes through which the spindle 25 is passed are formed in the side walls of the magazine lid 36 in the vicinity of the rear ends thereof. In addition, the driving blade locking projection 36*c* is a projection on which the driving blade 46 of the leaf spring 45 attached to the push-down portion 5 is locked, and the spring attaching portion 36*b* is a portion to which one end of a coil spring 43 is attached.

In addition, as is shown in FIG. 4, the damper spring 49, which is made up of the helical compression spring, is disposed on an upper surface of the flat plate of the magazine lid 36 in the vicinity of the front end thereof. This damper spring 49 has functions to bias the push-down portion 5 upwards and to enable a smooth clinching operation by damping impact generated at the time of clinching.

The staple thrusting mechanism is, as is shown in FIG. 8, made up of the staple thrusting member 41 for thrusting wire staples accommodated in the magazine main body 31 to the front end thereof and the coil spring 43 which biases the staple thrusting member 41. In addition, the staple thrusting member 41 is made up of a rectangular flat plate, side walls which are suspended from ridge portions of the flat plate, bent-back portions which are bent inwards at right angles from lower ends of the side walls so suspended and the sliding support piece 41*a* which is formed in the vicinity of a rear end of the flat plate, and the staple thrusting member 41 is mounted on the magazine main body 31 in such a manner as to straddle the sliding assist member 33.

The coil spring 43 is a helical tension spring and is attached to the spring attaching portion 36*b* which is formed in the vicinity of the rear end of the magazine lid 36 at one end thereof, while the coil spring 43 is returned round the spring supporting member 44 provided in the vicinity of the distal end of the magazine lid 36 to be attached to the staple thrusting member 41 at the other end thereof.

In addition, this staple thrusting mechanism is such as to bias forwards the staple thrusting member 41 by virtue of the elastic force of the coil spring 43, and when wire staples are accommodated in the magazine main body 31, the staple thrusting member 41 thrusts the wire staples against the front end of the magazine main body 31 so as to position the wire staples at the front end of the magazine main body 31 at all times.

Figure 10:
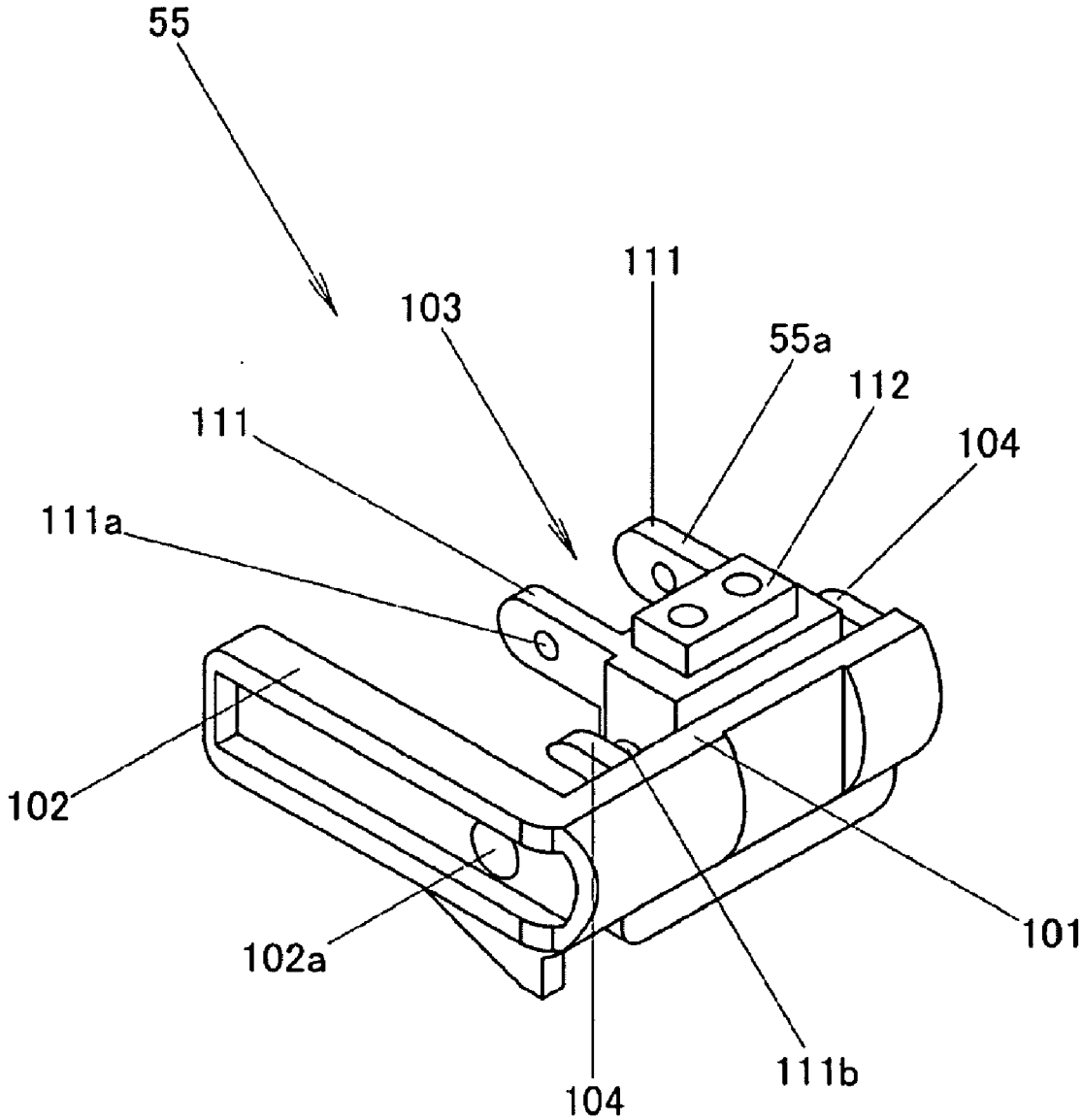
FIG. 10 is a perspective view of a rear end locking member of the stapler according to the embodiment of the invention.

The magazine main body locking mechanism is disposed in the vicinity of the rear end of the magazine accommodating portion 32 and includes the rear end locking member 55 which is locked in the rear end locking grooves 31*b* of the magazine main body 31. As is shown in FIG. 10, this rear end locking member 55 includes a substantially quadrangular rear plate 101 which is disposed at the rear, a gripping portion 102 which is formed in such a manner as to project forwards from a left end edge of the rear plate 101 and which includes a shaft hole 102*a* through which the spindle 25 is passed, a rear end locking portion 103 which is formed substantially in a center of a front surface of the rear plate 101, and rotatable attaching portions 104 which are disposed in positions lying in the vicinity of both sides of the rear end locking portion 103.

This rear end locking portion 103 is made up of two L-shaped plates 111 which are disposed to face each other and a connecting portion 112 which connects together those L-shaped plates 111 in the vicinity of corner portions, and rear end edges of the L-shaped plates 111 and a rear end surface of the connecting portion 112 are connected to the rear plate 101. In addition, locking shaft holes 111*a* through which a locking shaft 106, which is shown in FIG. 8, is passed through are formed in the vicinity of front ends of the L-shaped plates 111, and shaft holes 111*b* through which the spindle 25 is passed are formed in the vicinity of rear lower ends of the L-shaped plates 111. In addition, the rotatable attaching portions 104 are each formed into a U-shape at a front end thereof, and the spindle 25 is passed through these U-shaped portions.

As is shown in FIG. 8, the rear end locking member 55 is disposed in the vicinity of the rear end of the magazine accommodating portion 32 and is rotatably attached to the magazine accommodating portion 32 by the spindle 25. In addition, as is shown in FIG. 9, such that portions of both side walls 35*a* and 36*f* of the magazine receiving member 35 and the magazine lid 36 which lie in the vicinity of the rear ends thereof are positioned between the L-shaped plates 111 and the rotatable attaching portions 104. In addition, and that although not shown, portions of a push-down member 51, which will be described later, and the pedestal member 11 which lie in the vicinity of rear ends thereof are positioned between the left-hand side rotatable attaching portion 104 and the gripping portion 102. and the rear end locking member 55 is, as is shown in FIG. 8, rotatably attached to the magazine accommodating portion 32 by the spindle 25.

In addition, a helical torsion spring 115 having two coiled portions is disposed between the two L-shaped plates 111 in such a manner that the spindle 25 passes through the two coiled portions, and the locking shaft 106 is passed through the locking shaft holes 111*a* in the L-shaped plates 111 in such a manner as to project outwards slightly from the locking shaft holes 111*a* at both ends thereof. Furthermore, the helical torsion spring 115 is locked on the locking shaft 106 at one end and on the rear end of the flat plate of the magazine receiving member 35 at the other end, so as to bias the rear end locking member 55 in such a manner as to rotate the rear end locking member 55 forwards.

Then, when the magazine main body 31 is accommodated within the magazine accommodating portion 32, in the magazine main body locking mechanism, although the ends of the locking shaft 106 are locked respectively in the rear end locking grooves 31*b* of the magazine main body 31 so as to disable the magazine main body 31 from sliding, when the gripping portion 102 is rotated upwards about the spindle 25, the locking between the rear end locking grooves 31*b* of the magazine main body 31 and the ends of the locking shaft 106 is released, whereby the magazine main body 31 is caused to slide to the front by virtue of the biasing force of the staple thrusting mechanism which is exerted to the front. As this occurs, since the magazine main body 31 is braked in a predetermined position by the stoppers 36*d* of the magazine lid 36 shown in FIG. 9, the magazine main body 31 does not spring out to the front in any case, and after it has been stopped by the stoppers 36*d*, the magazine main body 31 can be made to project forwards by pulling it out by griping on the gripping member 38.

In addition, when the magazine main body 31 is accommodated back into the magazine accommodating portion 32 from the state in which the magazine main body 31 is projecting forwards therefrom, the tapered portions 31*e* of the magazine main body 31, which are shown in FIG. 8, and the ends of the locking shaft 106 are brought into contact with each other, whereby the locking shaft 106 is guided by the tapered portions 31*e* so as to be locked in the rear end locking grooves 31*b* of the magazine main body 31 again, thereby the magazine main body 31 being disabled from sliding.

In addition, as is shown in FIG. 2, the push-down portion 5 is such as to include the push-down member 51 which is disposed above the magazine portion 3 and is rotatably attached thereto by the spindle 25 and a handle connecting member 52 which is positioned at a front end of the push-down member 51 so as to be connected to the handle portion 6, which will be described later.

Figure 11:
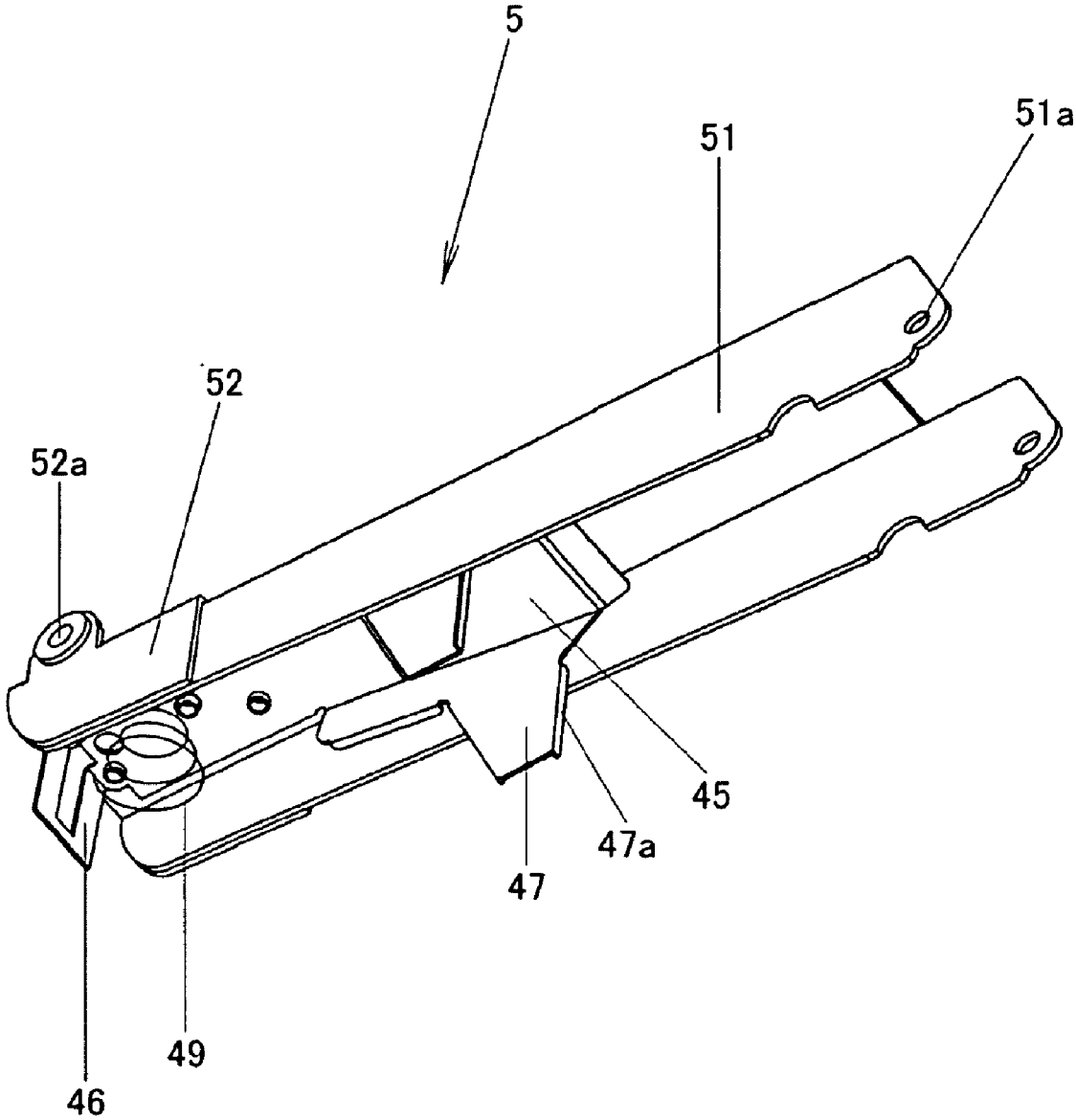
FIG. 11 is a perspective view of a push-down member of the stapler according to the embodiment of the invention.

As is shown in FIG. 11, the push-down member 51 is made up of a quadrangular flat plate and two side walls which are suspended to the rear from both side edges of the flat plate. In addition, rear ends of the side walls project further rearwards than a rear end of the flat plate, and the side walls have shaft holes 51*a* through which the spindle 25 is passed in the vicinity of the rear ends thereof. The leaf spring 45 which includes the driving blade 46 is attached to a bottom surface of the flat plate, and the damper spring 49, which is made up of the helical compression spring, is disposed in the vicinity of the front end of the leaf spring 45. In addition, the leaf spring 45 and the damper spring 49 bias the push-down member 51 upwards away from the magazine lid 36.

In addition, the handle connecting member 52 is such as to connect together the handle portion 6 and the push-down portion 5 and is made up of a quadrangular flat plate and two side walls which are suspended from the flat plate. Front ends of the side walls project further forwards than a front end of the flat late, and these projecting portions have shaft holes 52*a* through which a connecting shaft 66, which will be described later, is passed in upper portions thereof. This handle connecting member 52 is disposed in the vicinity of the front end of the push-down member 51 in such a manner that the flat plate of the handle connecting member 52 is superposed on the flat plate of the push-down member 51 and is connected to the handle portion 6 by the connecting shaft 66, which will be described later.

In addition, the leaf spring 45 is such that the driving blade 46 disposed at the front end and the slider thrusting portions 47 disposed in the vicinity of the rear end thereof are formed integrally therewith, and the driving blade 46 includes an opening in which the driving blade locking projection 36*c* of the magazine lid 36 shown in FIG. 9 is locked, whereby when the stapler 1 is used, a wire staple which is situated in the distal end portion of the magazine main body 31 is driven downwards from the drive-out port 31*a* shown in FIG. 8 by the driving blade 46 towards the movable clincher 15.

Figure 12:
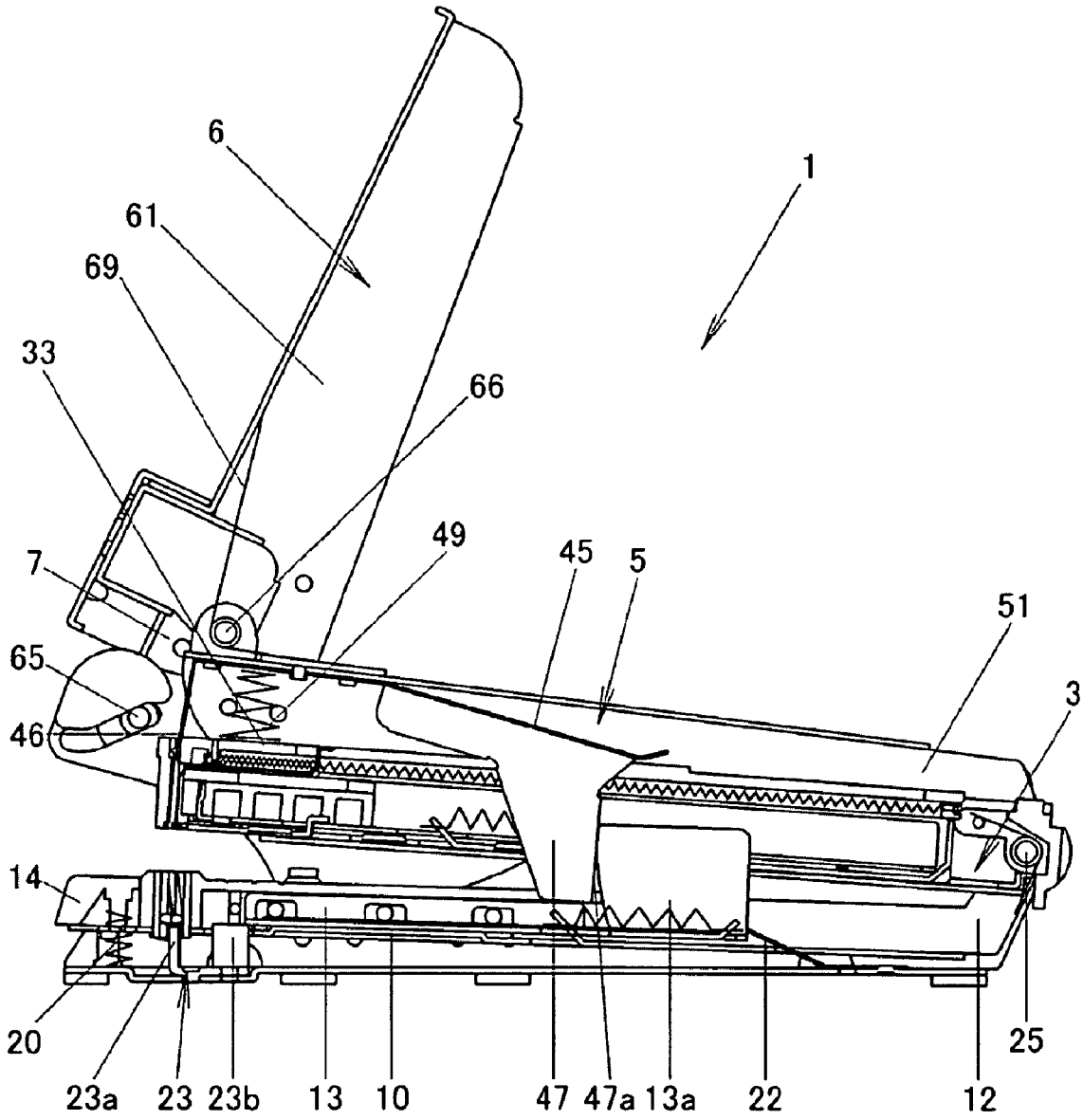
FIG. 12 is a sectional view which explains the operation of the stapler according to the embodiment of the invention.

The slider thrusting portions 47 are formed in such a manner as to project obliquely rearwards from the side ridge portions of the leaf spring 45, respectively, and rear ends thereof which are to be locked on the slider 13 are bent outwards so as to constitute plate bent portions 47*a*. In addition, the slider thrusting portions 47 are disposed outside of the sidewalls of slider 13 as shown in FIG. 12, the plate bent positions 47*a* of the slider thrusting positions 47 are brought into contact with the sliding support portions 13*a* of the slider 13, whereby in the event that the leaf spring 45 is pressed between the magazine lid 36 and the push-down member 51 to thereby be deflected, distal end portions of the slider thrusting portions 47 are caused to move rearwards by the deflection of the leaf spring 45 so as to be locked on the sliding support portions 13*a* of the slider 13, which is then caused to slide rearwards.

Then, since a vertical position where the leaf spring 45 starts to be deflected changes depending upon the thickness of a bundle of sheets of paper which is placed on the table 14, a position where the rear ends of the slider thrusting portions 47 move rearwards differ depending upon the thickness of the bundle of sheets of paper which is placed on the table 14. However, as has been described heretofore, since the front end faces of the sliding support portions 13*a* of the slider 13 are formed into the curved shape, the timing at which the slider thrusting portions 47 start thrusting the slider 13 becomes the same, whereby the timing of clinching becomes constant.

Figure 13:
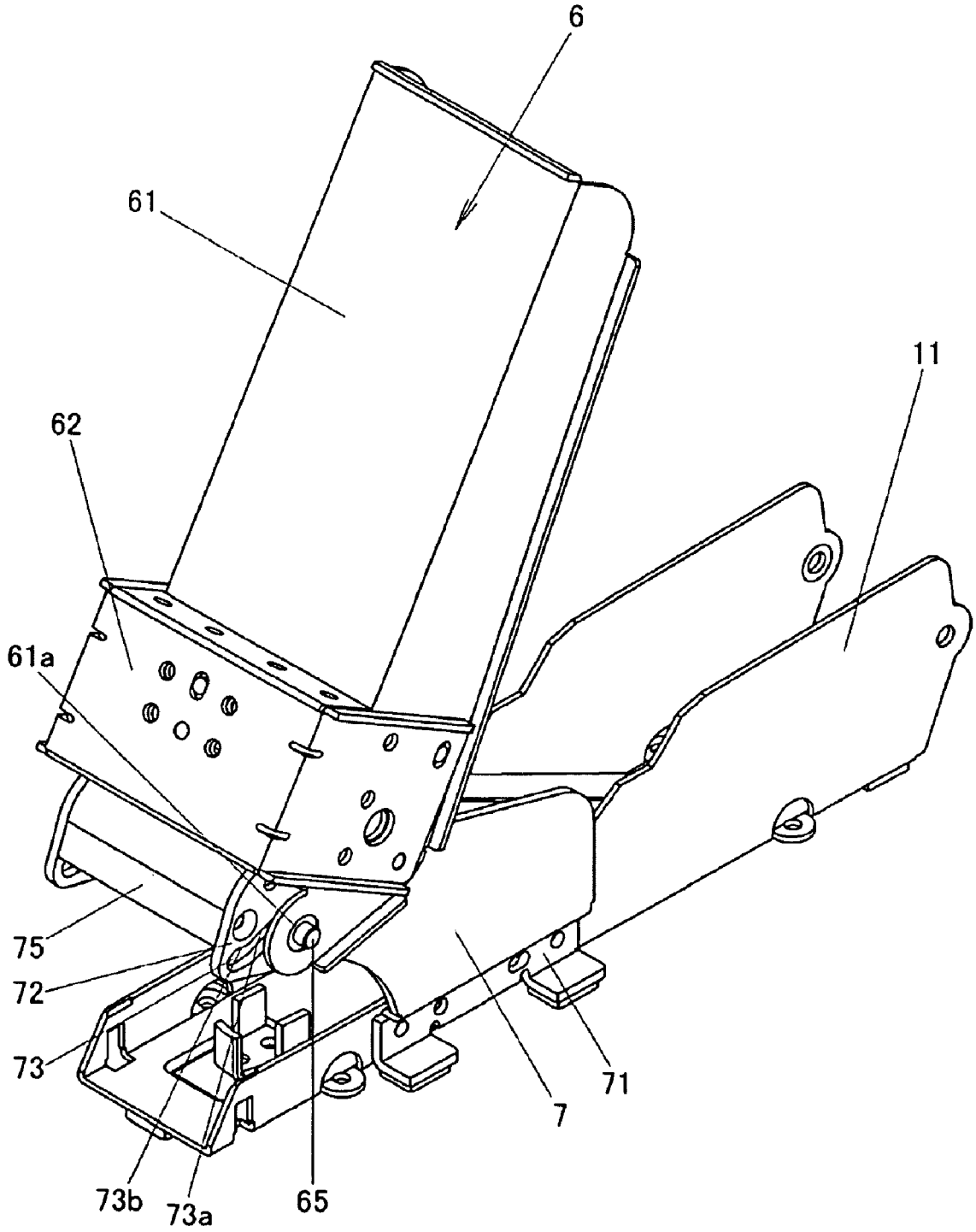
FIG. 13 is a perspective view showing a handle member, handle supporting members and a pedestal member of the stapler according to the embodiment of the invention.

The handle supporting members 7 are such as to support the handle portion 6 and each include, as is shown in FIG. 13, a fixing portion 71 which is positioned in a lower portion thereof and is fixed to the pedestal member 11 and a handle supporting portion 72 which is positioned forwards of and above the fixing portion 71 and in the vicinity of the front end of the stapler 1, and the guide rail 73 in which the handle shaft 65 slides is formed in the handle supporting portion 72. In addition, the two symmetrically shaped handle supporting members 7 are disposed on both sides of the stapler 1 in such a manner as to face each other, and the fixing portions 71 are screwed to lower portions of the side walls of the pedestal member 11.

This guide rail 73 is formed into a substantially circular arch shape through which the handle shaft 65 is passed, and an upper edge of the guide rail 73 is made up of an ascending or descending inducing portion 73*a* which extends forwards and downwards substantially from a center of the handle supporting portion 72, and a clinching inducing portion 73*b* which extends forwards and slightly upwards from a lower end of the ascending or descending inducing portion 73*a*.

Figure 14:
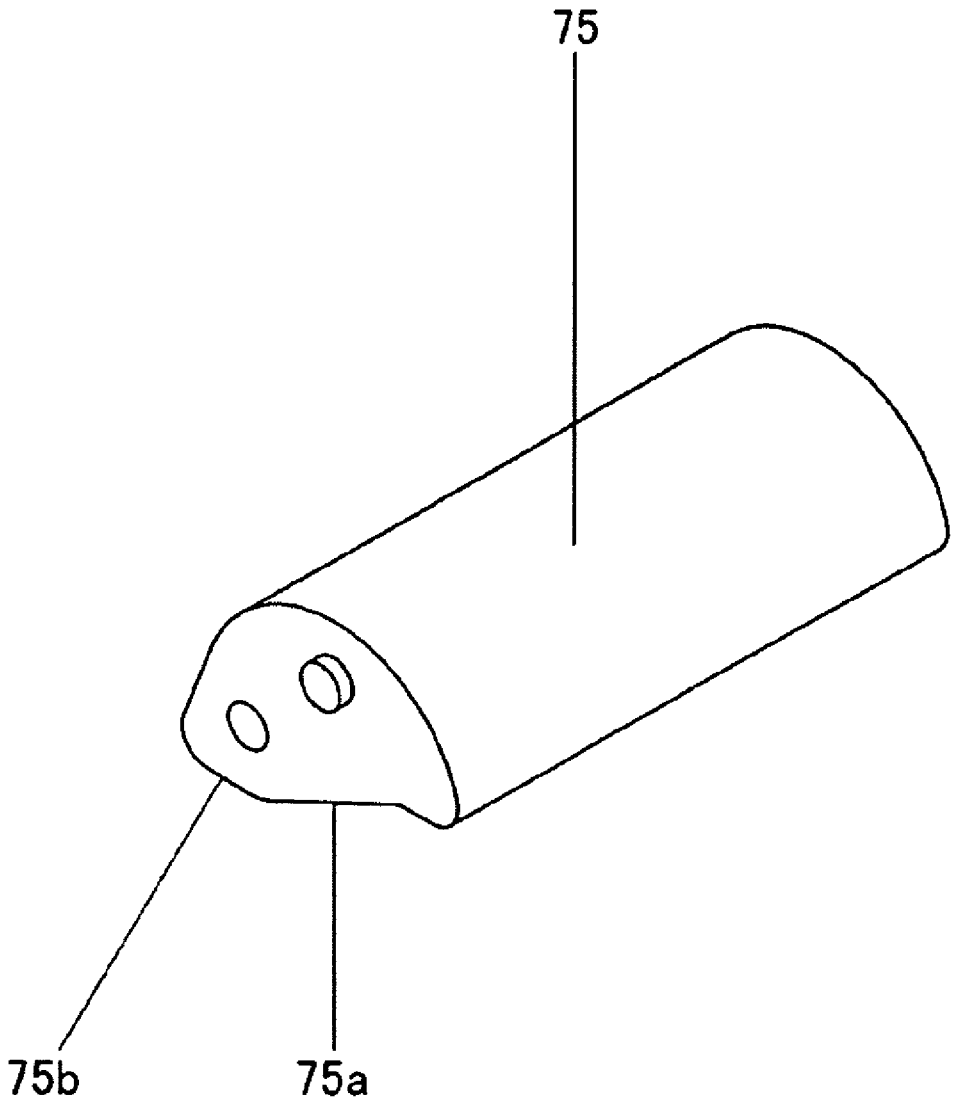
FIG. 14 is a perspective view of a guide member of the stapler according to the embodiment of the invention.

In addition, the guide member 75 which supports the handle shaft 65 in operation is disposed in the vicinity of the guide rails 73 inside the two handle supporting members 7 which are disposed to face each other. This guide member 75 is made of a resin and includes, as is shown in FIGS. 13 and 14, an ascending or descending inducing surface 75*a* whose cross sectional shape is substantially the same as that of the ascending or descending inducing portion 73*a* and a clinching inducing surface 75*b* whose cross sectional shape is substantially the same as that of the clinching inducing portion 73*b* of the guide rail 73 in a lower portion thereof, an upper portion thereof being formed into the shape of a curved surface. In addition, as is shown in FIGS. 12 and 13, the guide member 75 is fixed to the handle supporting members 7 in such a manner that the ascending or descending inducing portions 73*a* of the guide rails 73 and the ascending or descending inducing surface 75*a* approach each other, while the clinching inducing portions 73*b* of the guide rails 73 and the clinching inducing surface 75*b* approach each other and a lower surface of the guide member 75 slightly projects into the guide rails 73 from upper edges of the guide rails 73.

The handle portion 6 is such as to include, as is shown in FIG. 13, a handle member 61 which is attached to the handle supporting members 7 by the handle shaft 65, a reinforcement member 62 which reinforces a portion of the handle member 61 which lies in the vicinity of a front end thereof, and a push-down portion connecting member 63 which is connected to the push-down portion 5, which is shown in FIG. 3, by the connecting shaft 66. In addition, the connecting shaft 66 is, as is shown in FIG. 12, located in a position which lies in the vicinity of the front end of the push-down member 5, that is, above the driving blade 46, and the handle shaft 65 is positioned further forwards than the connecting shaft 66. Then, the handle portion 6 causes the push-down portion 5 to descend through the principle of the lever with the handle shaft 65 made to act as a fulcrum, the connecting shaft 66 as a point of application of force and a distal end portion of the handle member 61 as a point of action of force.

As is shown in FIG. 13, this handle member 61 is made up of a quadrangular plate and side walls which are suspended from both side edges of the flat plate. A portion of the flat plate which lies in the vicinity of a front end thereof is bent upwards into a bent portion, and front ends of the side walls project further forwards than the front end of the flat plate. Shaft holes 61*a* through which the handle shaft 65 is passed are formed in the side walls at the front ends thereof, whereby the handle member 61 is rotatably attached to the guide rails 73 of the handle supporting members 7 by the handle shaft 65.

In addition, the reinforcement member 62 includes a quadrangular flat plate, side walls which are suspended from both side edges of the flat plate and a bent portion which is formed by a rear end edge of the flat plate being bent downwards and is disposed in the vicinity of the front end of the handle member 61 in such a manner that the side walls of the reinforcement member 62 are superposed on the side walls of the handle member 61, whereby the reinforcement member 62 is fixed to the handle member 61 by fixing together the bent portion of the handle member 61 and the bent portion of the reinforcement member 62. This reinforcement member 62 reinforces the portion of the handle member 61 lying in the vicinity of the front end thereof where the handle shaft 65 and the connecting shaft 66 are located and on which strong load is exerted at the time of clinching.

Furthermore, the push-down portion connecting member 63 includes, as is shown in FIG. 4, a quadrangular flat plate, side walls which are suspended from both side edges of the flat plate and bent portions which are formed by bending front and rear end edges of the flat plate and has shaft holes through which the connecting shaft 66 is passed through in positions on the side walls which lie in the vicinity of front lower ends thereof. In addition, this push-down portion connecting member 63 is disposed underneath the reinforcement member 62, and the rear end bent portion of the flat plate is fixed to the bent portion of the handle member 61 together with the bent portion of the reinforcement member 62.

In addition, the push-down portion connecting member 63 is disposed in such a manner as to straddle the handle connecting member 52 of the push-down portion 5, and as is shown in FIG. 3, a helical torsion spring 69 having two coiled portions is disposed inside the handle connecting member 52. The connecting shaft 66 is passed through the shaft holes of the push-down portion connecting member 63, the shaft holes of the handle connecting member 52 and the coiled portions of the helical torsion spring 69 so as to connect the respective members together, and the helical torsion spring 69 biases the handle portion 6 upwards.

Figure 15:
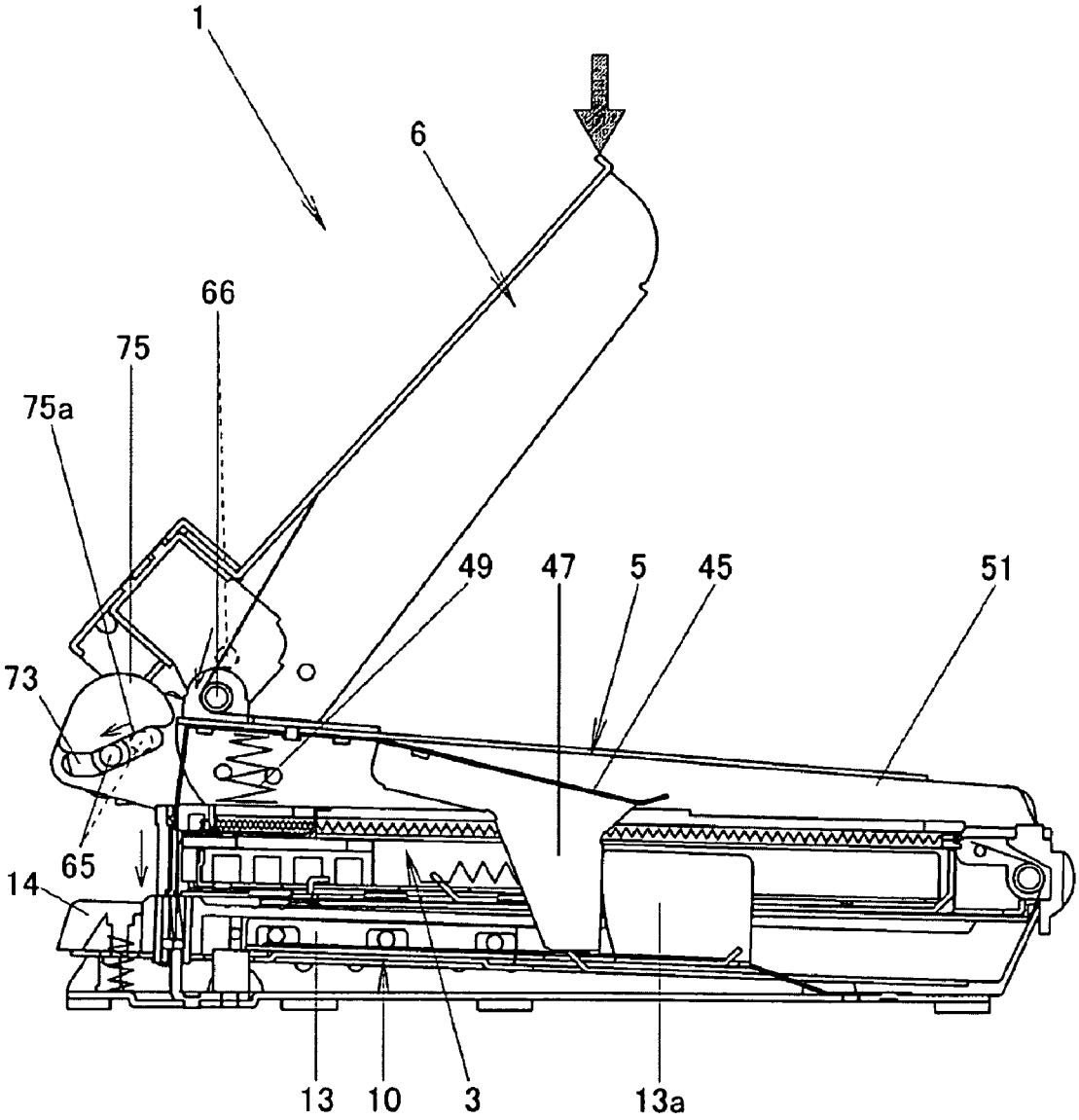
FIG. 15 is a sectional view which explains the operation of the stapler according to the embodiment of the invention.

Next, the operation of the stapler 1 will be described. As is shown in FIG. 12, sheets of paper are placed on the table 14 in such a state that the handle portion 6 is opened, and when a force is exerted on the handle portion 6 from above as is shown in FIG. 15, the handle shaft 65 slides forwards downwards along the ascending or descending inducing surface 75*a* of the guide member 75 inside the guide rails 73 and the connecting shaft 66 is caused to descend, whereby the push-down portion 5 is pushed down by the connecting shaft 66, and the magazine portion 3 is also pushed down by the push-down portion 5, thus the front end of the lower portion of the magazine portion 3 being brought into contact with the table 14 of the clinching portion 10. In this state, the leaf spring 45 and the damper spring 49 which are disposed between the magazine portion 3 and the push-down member 51 are not compressed.

Figure 16:
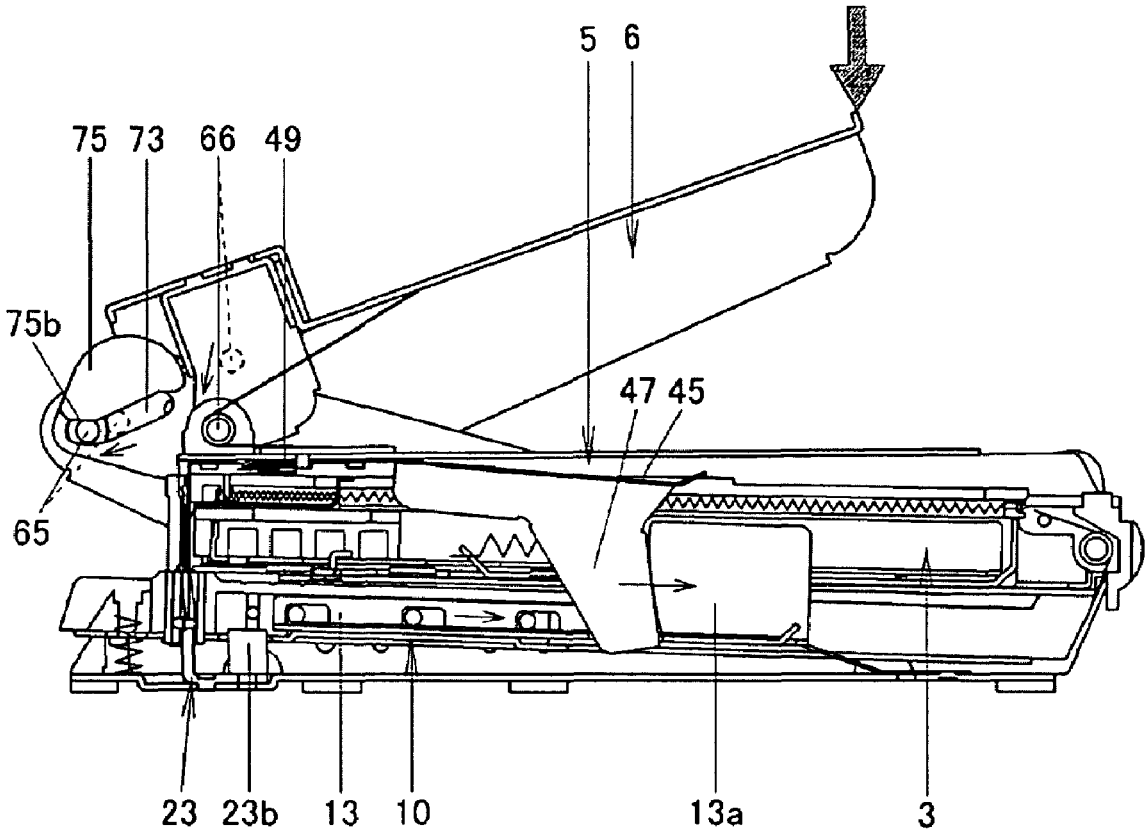
FIG. 16 is a sectional view which explains the operation of the stapler according to the embodiment of the invention.

After the table 14 and the front end of the lower portion of the magazine portion 3 have been brought into contact with each other, when the force is exerted further on the handle portion 6 from above, the handle shaft 65 slides forwards along the clinching inducing surface 75*b* of the guide member 75 within the guide rails 73 as is shown in FIG. 16, and the connecting shaft 66 is caused to descend further. As this occurs, since the clinching portion 10 does not descend due to the slider locking portions 23*b* of the locking member 23 locking the slider 13, the leaf spring 45 and the damper spring 49 are compressed by being held by the magazine lid 36 and the push-down member 51, and the driving blade 46 pushes down a wire staple to such an extent that the crown of the wire staple is brought into contact with the surface of a sheet of paper. In addition, the distal end portions of the slider thrusting portions 47, which are formed integrally with the leaf spring 45, move to the rear so as to be brought into locking engagement with the sliding support portions 13*a* of the slider 13 to thereby cause the slider 13 to slide to the rear.

Figure 17:
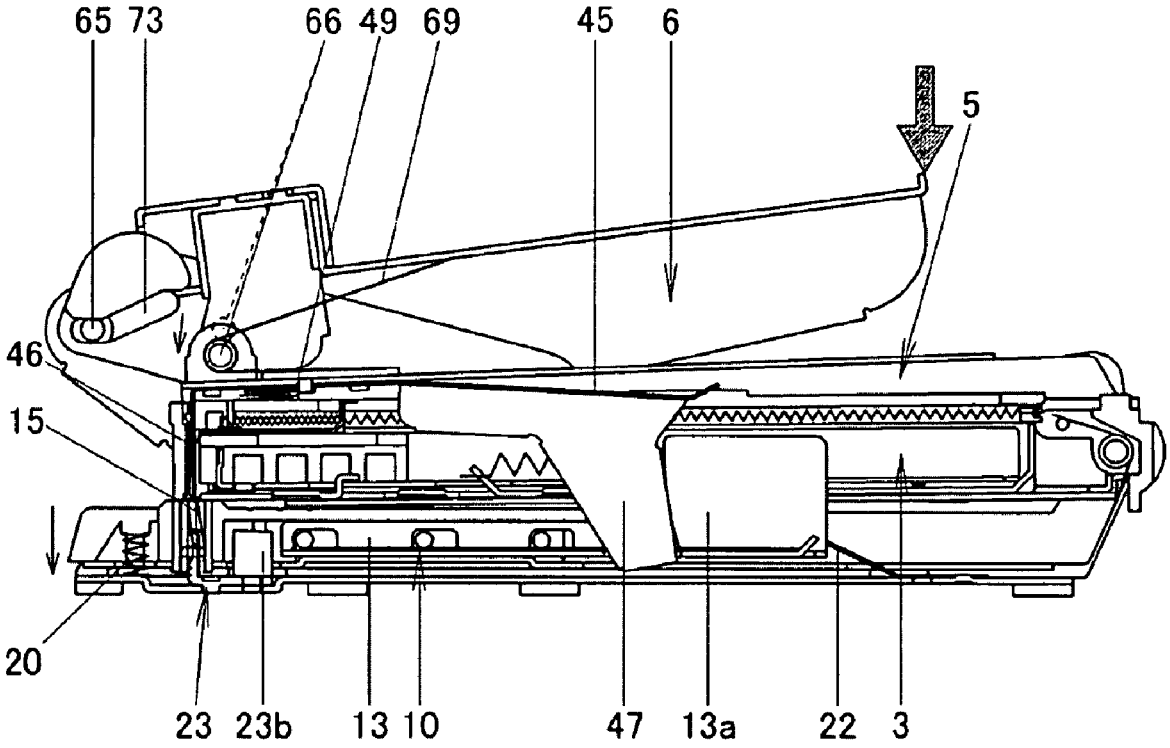
FIG. 17 is a sectional view which explains the operation of the stapler according to the embodiment of the invention.

When the force is exerted much more on the handle portion 6 from above, since, as is shown in FIG. 17, the handle shaft 65 stops in the vicinity of the front ends in the guide rails 73 and the connecting shaft 66 is caused to descend further, the slider thrusting portions 47 of the leaf spring 45 are locked on the sliding support portions 13*a* of the slider 13, and the slider 13 is caused to slide to the rear, whereby the locking between the slider 13 and the locking member 23 is released to thereby allow the clinching portion 10 to descend, thereby causing the driving blade 46 of the leaf spring 45 and movable clincher 15 to approach each other so as to clinch the wire staple.

In addition, when this clinching is effected, although since the locked state between the slider 13 and the locking member 23 is released to cause the table 14 to descend drastically, impact is transmitted to the handle portion 6 as well, the impact transmitted to the handle portion 6 is reduced because the damper spring 49 absorbs the impact.

Thereafter, when the handle portion 6 is released, the handle portion 6 rotates upwards by virtue of the force exerted by the helical torsion spring 69 mounted on the connecting shaft 66, the push-down portion 5 is raised by virtue of the force exerted by the leaf spring 45 and the damper spring 49, the magazine portion 3 is raised by the magazine biasing spring 22, the clinching portion 10 is raised by virtue of the force exerted by the table biasing spring 20 due to the locking between the slider thrusting portions 47 of the leaf spring 45 and the sliding support portions 13*a* of the slider 13 being released, and the slider 13 is caused to slide back to the original position by virtue of the biasing force of the helical tension spring, thus, the respective members being returned to their original positions as is shown in FIG. 12.

According to the stapler 1 of the embodiment, by adopting the construction in which the handle portion 6 is rotatably attached above the position where the push-down portion 5 and the driving blade 46 are disposed by the connecting shaft 66 and is rotatably attached to the guide rails 73 of the handle supporting members 7 by the handle shaft 65 to thereby cause the push-down portion 5 to descend through the principle of the lever with the handle shaft 65 made to act as the movable fulcrum, the portion on the handle portion 6 lying in the vicinity of the rear end thereof as the point of application of force, the connecting shaft 66 as the point of action of force, since the principle of the lever is made use of in this way, not only can the assist ratio, which is the load reduction ratio, be ensured in an optimum fashion but also the relative positional relationship between fulcrum, point of application of force and point of action of force can be made constant, thereby making it possible to make constant the assist ratio at the time of clinching at all times.

In addition, by forming each of the guide rails 73 of the handle supporting members 7 into the shape having the ascending or descending inducing portion 73*a* which extends forwards and downwards and the clinching inducing portion 73*b* which extends forwards slightly upwards from the lower end of the ascending or descending inducing portion 73*a*, the push-down distance required at the time of clinching can be ensured while maintaining the assist ratio constant.

Furthermore, since not only can wear of the metallic members be prevented but also the frictional force is weakened by causing the handle shaft 65 to slide along the guide member

75 made of resin, clinching can be effected with a weak force, and the durability of the stapler can be enhanced, as well.

In addition, by disposing the damper spring 49 in the position which lies between the magazine portion 3 and the push-down portion 5 which is in the vicinity of the front ends thereof, the impact produced when the locking between the slider 13 and the locking member 23 is released to thereby cause the clinching portion 10 to descend drastically, which is inherent in the flat-type stapler, can be mitigated.

Note that while the embodiment has been described as the invention being applied to the flat-type desktop stapler, the invention can be applied to a hand-held stapler which can fasten together sheets of paper with a light force. In addition, the invention is not limited to the embodiment that has been described heretofore, and the techniques described in the embodiment can be applied to various products.

What is claimed is:

1. A stapler comprising:

a base portion having a rotatable clinching portion;

a magazine portion which is rotatably attached to a portion of the base portion which lies in the vicinity of a rear end thereof by means of a spindle;

a push-down member which is rotatably attached to a portion of the base portion which lies in the vicinity of the rear end thereof in such a manner as to be disposed above the magazine portion and which has a driving blade in the vicinity of a front end thereof;

handle supporting members which are fixed to the base portion and which have guide rails in which a handle shaft slides in the vicinity of front ends of upper portions thereof; and a handle portion which is rotatably attached to the push-down portion by means of a connecting shaft and which is rotatably attached by means of a handle shaft which can slide in the guide rails of the handle supporting members above the position where the driving blade is disposed; wherein the handle portion causes the push-down portion to descend by virtue of the principle of the lever with the handle shaft made to act as a movable fulcrum, a portion of the handle portion which lies in the vicinity of a rear end thereof as a point of application of force, and the connecting shaft as a point of action.

2. A stapler as set forth in claim 1, wherein the guide rails of the handle supporting members each have an ascending or descending inducing portion which extends forwards and downwards and a clinching inducing portion which extends forwards and slightly upwards from a lower end of the ascending or descending inducing portion.

3. A stapler as set forth in claim 2, wherein a guide member made of a resin is provided directly above the guide rails, a lower surface of the guide member having an ascending or descending inducing surface whose cross sectional shape is substantially the same as that of the ascending or descending inducing portion and a clinching inducing surface whose cross sectional shape is substantially the same as that of the clinching inducing portion of the guide rail, and is disposed in such a manner that the lower surface of the guide member projects slightly into the guide rails from upper edges of the guide rails, so as to cause the handle shaft to slide along the lower surface of the guide member.

* * * * *